US009523161B2

(12) United States Patent
Takebe et al.

(10) Patent No.: US 9,523,161 B2
(45) Date of Patent: Dec. 20, 2016

(54) ELASTIC NONWOVEN FABRIC, PROCESS FOR PRODUCING THE SAME, AND TEXTILE PRODUCT COMPRISING THE ELASTIC NONWOVEN FABRIC

(75) Inventors: Tomoaki Takebe, Ichihara (JP); Yutaka Minami, Ichihara (JP); Toshitaka Kanai, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 1105 days.

(21) Appl. No.: 12/666,061

(22) PCT Filed: Jun. 25, 2008

(86) PCT No.: PCT/JP2008/061575
§ 371 (c)(1),
(2), (4) Date: Dec. 22, 2009

(87) PCT Pub. No.: WO2009/001871
PCT Pub. Date: Dec. 31, 2008

(65) Prior Publication Data

US 2010/0190405 A1 Jul. 29, 2010

(30) Foreign Application Priority Data

| | | |
|---|---|---|
| Jun. 26, 2007 | (JP) | 2007-167210 |
| Aug. 16, 2007 | (JP) | 2007-212064 |
| Sep. 4, 2007 | (JP) | 2007-229320 |
| Feb. 7, 2008 | (JP) | 2008-027560 |
| Apr. 1, 2008 | (JP) | 2008-095239 |

(51) Int. Cl.

| | |
|---|---|
| ***D04H 13/00*** | (2006.01) |
| ***D01F 8/06*** | (2006.01) |
| ***D01F 1/10*** | (2006.01) |
| ***D01F 6/46*** | (2006.01) |
| ***D04H 1/4291*** | (2012.01) |
| ***D04H 1/4382*** | (2012.01) |
| ***D04H 3/007*** | (2012.01) |
| ***D04H 3/147*** | (2012.01) |
| ***D04H 3/16*** | (2006.01) |

(52) U.S. Cl.
CPC . *D01F 8/06* (2013.01); *D01F 1/10* (2013.01); *D01F 6/46* (2013.01); *D04H 1/4291* (2013.01); *D04H 1/4382* (2013.01); *D04H 3/007* (2013.01); *D04H 3/147* (2013.01); *D04H 3/16* (2013.01); *Y10T 442/601* (2015.04)

(58) Field of Classification Search
CPC .... D01F 1/10; Y10T 442/601; Y10T 442/637; D04H 13/00
See application file for complete search history.

(56) References Cited

U.S. PATENT DOCUMENTS

| | | | | |
|---|---|---|---|---|
| 6,156,679 | A * | 12/2000 | Takaoka et al. | 442/327 |
| 2004/0122196 | A1* | 6/2004 | Pierini et al. | 526/351 |
| 2004/0161992 | A1* | 8/2004 | Clark et al. | 442/340 |

(Continued)

FOREIGN PATENT DOCUMENTS

| | | |
|---|---|---|
| JP | 01 111055 | 4/1989 |
| JP | 10 088458 | 4/1998 |

(Continued)

OTHER PUBLICATIONS

Office Action issued May 15, 2012, in Japanese Patent Application No. 2008-185244.
Office Action issued May 15, 2012, in Japanese Patent Application No. 2008-095239.
Office Action issued May 15, 2012, in Japanese Patent Application No. 2008-185247.
U.S. Appl. No. 13/581,904, filed Aug. 30, 2012, Takebe, et al.
U.S. Appl. No. 13/574,085, filed Aug. 2, 2012, Takebe, et al.
Office Action issued Mar. 26, 2013 in Japanese Patent Application No. 2008-185244.

*Primary Examiner* — Peter Y Choi
(74) *Attorney, Agent, or Firm* — Oblon, McClelland, Maier & Neustadt, L.L.P.

(57) ABSTRACT

(1) An elastic nonwoven fabric and a fiber product using the elastic nonwoven fabric, the elastic nonwoven fabric containing a crystalline resin composition containing low crystalline polypropylene and high crystalline polypropylene, the low crystalline polypropylene satisfying items (a) and (b) below, and a crystallization temperature (Tc) of the crystalline resin composition measured with a differential scanning calorimeter (DSC) being from 20 to 100° C.:
(a) a melting point (Tm-D) being from 0 to 120° C., which is defined as a peak top of a peak observed on the most high temperature side of a melt endothermic curve obtained by maintaining at −10° C. for 5 minutes and increasing in temperature at 10° C. per minute in a nitrogen atmosphere with a differential scanning calorimeter (DSC); and
(b) a stereoregularity index ([mm]) being from 50 to 90% by mol;
(2) an elastic nonwoven fabric and a fiber product using the elastic nonwoven fabric, the elastic nonwoven fabric being produced by using a crystalline resin composition containing low crystalline polypropylene satisfying items (c) to (h) below, and a releasing agent: (c) [mmmm]=20 to 60% by mol; (d) [rrrr]/(1−[mmmm])≤0.1; (e) [rmrm]>2.5% by mol; (f) [mm]×[rr]/[mr]$^2$≤2.0; (g) mass average molecular weight (Mw)=10,000 to 200,000; and (h) molecular weight distribution (Mw/Mn)<4; and
(3) an elastic nonwoven fabric and a fiber product using the elastic nonwoven fabric, the elastic nonwoven fabric containing core/shell type composite fibers containing low crystalline polypropylene satisfying the items (c) to (h) have excellent elastic recovery property and pleasant texture without stickiness.

7 Claims, No Drawings

(56) References Cited

U.S. PATENT DOCUMENTS

| | | | | |
|---|---|---|---|---|
| 2005/0043495 | A1 | 2/2005 | Minami et al. | |
| 2005/0106978 | A1 | 5/2005 | Cheng et al. | |
| 2006/0293471 | A1 | 12/2006 | Minami et al. | |
| 2007/0043192 | A1 | 2/2007 | Okamoto et al. | |
| 2007/0254176 | A1* | 11/2007 | Patel et al. | 428/519 |
| 2009/0098786 | A1* | 4/2009 | Tajima et al. | 442/327 |

FOREIGN PATENT DOCUMENTS

| | | | |
|---|---|---|---|
| JP | 11-255834 | A | 9/1999 |
| JP | 2001 172325 | | 6/2001 |
| JP | 2003 027331 | | 1/2003 |
| JP | 2003 129330 | | 5/2003 |
| JP | 2003-313724 | A | 11/2003 |
| JP | 2005-2279 | A | 1/2005 |
| JP | 2007 277755 | | 10/2007 |
| WO | 99 19547 | | 4/1999 |
| WO | 01 27372 | | 4/2001 |
| WO | 2006 051708 | | 5/2006 |
| WO | WO 2006051708 | A1 * | 5/2006 |
| WO | WO 2006/118794 | A2 | 11/2006 |

* cited by examiner

ELASTIC NONWOVEN FABRIC, PROCESS FOR PRODUCING THE SAME, AND TEXTILE PRODUCT COMPRISING THE ELASTIC NONWOVEN FABRIC

TECHNICAL FIELD

The present invention relates to an elastic nonwoven fabric that has excellent elastic recovery property and pleasant texture without stickiness, a method for producing the same, and a fiber product containing the elastic nonwoven fabric.

BACKGROUND ART

In recent years, elastic fibers and an elastic nonwoven fabric are being used for such various purposes as a disposable diaper, a sanitary product, a clothing material, a bandage and a packaging material. In particular, a disposable diaper, a sanitary product and the like are used in direct contact with the skin and are demanded to have appropriate stretchability and elastic recovery property from the standpoint of comfort upon wearing on the body and mobility of the body after wearing.

As elastic fibers imparted with elastic recovery property, Patent Document 1 discloses elastic fibers obtained by mixing an elastomer, such as an olefin copolymer and a styrene block copolymer, and another resin component. However, the elastomer is poor in compatibility with polypropylene and is non-crystalline, and in the case where elastic fibers are formed by mixing the elastomer and polypropylene, the elastomer bleeds to the surface of the fibers. Accordingly, there are problems that an elastic nonwoven fabric formed of the elastic fibers has stickiness, and a fiber product using the elastic nonwoven fabric lacks pleasant texture.

Patent Document 2 discloses that a propylene polymer constituting a nonwoven fabric is treated with a free radical initiator. The treatment improves the fluidity of the propylene polymer but lowers the heat stability of the propylene polymer.

Patent Document 3 discloses that fibers are formed with a crystalline propylene polymer composition containing a crystalline propylene copolymer and a crystalline isotactic propylene homopolymer. However, the crystalline propylene copolymer is poor in compatibility with the crystalline isotactic propylene homopolymer as compared to a low crystalline polypropylene, and therefore, there are possible problems of poor kneading property and deterioration in property due to bleed on the surface of the fibers.

Patent Document 4 discloses fibers containing an olefin homopolymer having [mmmm] of less than 60%, but fails to disclose a mixing ratio with polypropylene with high regularity to have a problem in balance between elasticity and moldability.

Patent Document 5 discloses a resin composition containing a propylene polymer having (mmmm) of from 0.2 to 0.6 and $[rrrr/(1-mmmm)] \leq 0.1$, but the mixing amount of a low crystalline polypropylene is insufficient, and when the fibers are formed and pulled, the fibers are stretched but stay stretched. Accordingly, such a resin composition is demanded that provides a material that does not stay stretched but shrinks, i.e., fibers having elastic recovery property.

Patent Document 6 discloses that fibers are formed with a propylene composition containing propylene and ethylene, and that core/shell type composite fibers are formed with a propylene composition containing propylene and ethylene as a shell component and high density polyethylene as a core component. However, the propylene composition containing propylene and ethylene is not necessarily sufficient in compatibility with a crystalline isotactic propylene homopolymer, and therefore, there are possible problems of poor kneading property and deterioration in property due to bleed on the surface of the fibers.

[Patent Document 1]
JP-A-2003-129330
[Patent Document 2]
JP-T-2007-511680
[Patent Document 3]
JP-T-2001-520324
[Patent Document 4]
JP-T-2003-511578
[Patent Document 5]
JP-A-2003-27331
[Patent Document 6]
JP-A-2007-277755

DISCLOSURE OF THE INVENTION

Problems to be Solved by the Invention

The present invention has been made in view of the aforementioned circumstances, and an object thereof is to provide an elastic nonwoven fabric that has excellent elastic recovery property and pleasant texture without stickiness, a method for producing the same, and a fiber product containing the elastic nonwoven fabric.

Means for Solving the Problems

As a result of earnest investigations made by the inventors, it has been found that an elastic nonwoven fabric containing low crystalline polypropylene attains the aforementioned object. Specifically, low crystalline polypropylene having low stereoregularity, a small crystallization speed and high affinity with high crystalline polypropylene can effectively plasticizes high crystalline polypropylene, whereby there is no necessity of a treatment with a free radical initiator for improving the fluidity, and high heat stability is obtained since the treatment is not performed. The inventors have found that the crystalline resin composition containing low crystalline polypropylene with high crystalline polypropylene added thereto is suitable for a material for forming an elastic nonwoven fabric, and thus have completed the first invention.

The inventors have found that a crystalline resin composition containing low crystalline polypropylene having low stereoregularity and a small crystallization speed is suitable for a material for forming an elastic nonwoven fabric. The inventors have found that upon producing the elastic nonwoven fabric, a releasing agent is dispersed on a movable collecting surface for collecting fibers obtained by spinning, whereby the fibers can be prevented from being adhered to the movable collecting surface, and thus have completed the second invention.

The inventors have found that core/shell type composite fibers containing low crystalline polypropylene having particular stereoregularity are excellent in elastic recovery property, are suppressed from undergoing stickiness, and are suitable for a material for forming an elastic nonwoven fabric, and thus have completed the third invention. The invention has been completed based on the knowledge.

The invention provides an elastic nonwoven fabric, a method for producing the same, and a fiber product containing the elastic nonwoven fabric, which are shown below.

1. An elastic nonwoven fabric containing a crystalline resin composition containing low crystalline polypropylene and high crystalline polypropylene, the low crystalline polypropylene satisfying items (a) and (b) below, and a crystallization temperature (Tc) of the crystalline resin composition measured with a differential scanning calorimeter (DSC) being from 20 to 100° C.:

(a) a melting point (Tm-D) being from 0 to 120° C., which is defined as a peak top of a peak observed on the highest temperature side of a melt endothermic curve obtained by maintaining at −10° C. for 5 minutes and increasing in temperature at 10° C. per minute in a nitrogen atmosphere with a differential scanning calorimeter (DSC); and (b) a stereoregularity index ([mm]) being from 50 to 90% by mol.

2. The elastic nonwoven fabric according to the item 1, wherein the crystalline resin composition contains a combination of from 80 to 99% by mass of the low crystalline polypropylene and from 20 to 1% by mass of the high crystalline polypropylene.

3. The elastic nonwoven fabric according to the item 1, wherein the low crystalline polypropylene satisfies items (c) to (h) below:

(c) [mmmm]=20 to 60% by mol;

(d) [rrrr]/(1−[mmmm]) 0.1;

(e) [rmrm]>2.5% by mol;

(f) $[mm]\times[rr]/[mr]^2\leq 2.0$;

(g) mass average molecular weight (Mw)=10,000 to 200,000; and (h) molecular weight distribution (Mw/Mn)<4.

4. An elastic nonwoven fabric produced by using a crystalline resin composition containing low crystalline polypropylene satisfying items (c) to (h) below, and a releasing agent:

(c) [mmmm]=20 to 60% by mol;

(d) [rrrr]/(1−[mmmm])≤0.1;

(e) [rmrm]>2.5% by mol;

(f) $[mm]\times[rr]/[mr]^2\leq 2.0$;

(g) mass average molecular weight (Mw)=10,000 to 200,000; and (h) molecular weight distribution (Mw/Mn)<4.

5. The elastic nonwoven fabric according to the item 4, wherein the low crystalline polypropylene further satisfies items (a) and (b) below:

(a) a melting point (Tm-D) being from 0 to 120° C., which is defined as a peak top of a peak observed on the highest temperature side of a melt endothermic curve obtained by maintaining at −10° C. for 5 minutes and increasing in temperature at 10° C. per minute in a nitrogen atmosphere with a differential scanning calorimeter (DSC); and (b) a stereoregularity index ([mm]) being from 50 to 90% by mol.

6. The elastic nonwoven fabric according to the item 4, wherein the crystalline resin composition contains the releasing agent.

7. The elastic nonwoven fabric according to the item 6, wherein a content of the releasing agent is from 10 to 10,000 ppm by mass based on the resin composition.

8. A method for producing the elastic nonwoven fabric according to one of the items 4 to 7, the method containing: spinning a molten product of the resin composition by extruding from a nozzle; and collecting fibers obtained by spinning with a movable collecting surface, an external releasing agent being dispersed on the collecting surface.

9. An elastic nonwoven fabric containing core/shell type composite fibers containing low crystalline polypropylene satisfying items (c) to (h) below:

(c) [mmmm]=20 to 60% by mol;

(d) [rrrr]/(1−[mmmm])≤0.1;

(e) [rmrm]>2.5% by mol;

(f) $[mm]\times[rr]/[mr]^2\leq 2.0$;

(g) mass average molecular weight (Mw)=10,000 to 200,000; and (h) molecular weight distribution (Mw/Mn)<4.

10. The elastic nonwoven fabric according to the item 9, wherein a shell component contains from 50 to 99% by mass of the low crystalline polypropylene and from 1 to 50% by mass of high crystalline polypropylene, a core component contains from 90 to 100% by mass of the low crystalline polypropylene and from 0 to 10% by mass of high crystalline polypropylene, and the elastic nonwoven fabric contains the core/shell type composite fibers having the core component containing the low crystalline polypropylene in a higher content than the shell component.

11. The elastic nonwoven fabric according to the item 9, wherein the elastic nonwoven fabric contains the core/shell type composite fibers having a total low crystalline polypropylene content calculated by the following expression of from 90 to 99% by mass:

$$\text{total low crystalline polypropylene content}=\{Ws(\%)\times Xs(\%)+Wc(\%)\times Xc(\%)\}/100(\%)$$

wherein

Ws: mass percentage of the shell component

Wc: mass percentage of the core component

Xs: mass percentage of the low crystalline polypropylene in the shell component

Xc: mass percentage of the low crystalline polypropylene in the core component

12. A fiber product containing the elastic nonwoven fabric according to one of the items 1 to 11.

Advantage of the Invention

According to the present invention, such an elastic nonwoven fabric is provided that has excellent elastic recovery property and pleasant texture without stickiness. The crystalline resin composition for forming the elastic nonwoven fabric of the present invention does not require a treatment with a free radical initiator for imparting fluidity to the crystalline resin composition, and thus an elastic nonwoven fabric can be obtained with a simplified process. Further, the elastic nonwoven fabric of the present invention has excellent properties, for example, excellent secondary fabrication property owing to good releasing property from a winding roller, excellent heat resistance, and no shrinkage upon coating HMA (hot-melt adhesive) thereon.

BEST MODE FOR CARRYING OUT THE INVENTION

First Invention

The elastic nonwoven fabric according to the first invention of the present invention (which may be hereinafter referred to as an elastic nonwoven fabric A) contains the crystalline resin composition containing the low crystalline polypropylene used in the first invention of the present invention (which may be hereinafter referred to as a low crystalline polypropylene A) and high crystalline polypropylene. The crystalline polypropylene in the present invention is polypropylene that has the aforementioned melting point (Tm-D) observed. The low crystalline polypropylene A is crystalline polypropylene that has a melting point of from 0 to 120° C., and the high crystalline polypropylene is crystalline polypropylene that has a melting point of 155° C. or more.

In the crystalline resin composition forming the elastic nonwoven fabric A of the present invention, the low crystalline polypropylene A and the high crystalline polypropylene are preferably a combination of from 80 to 99% by mass of the low crystalline polypropylene A and from 20 to 1% by mass of the high crystalline polypropylene, and is more preferably a combination of from 95 to 99% by mass of the low crystalline polypropylene A and from 5 to 1% by mass of the high crystalline polypropylene.

When the ratio of the high crystalline polypropylene is 1% by mass or more, the degree of crystallinity of the crystalline resin composition is not too low but is an appropriate value, whereby solidification of the crystalline resin composition proceeds to facilitate spinning. Furthermore, the fibers obtained by spinning are suppressed from shrinking, thereby facilitating formation of the nonwoven fabric. On the other hand, when the ratio of the high crystalline polypropylene is 20% by mass or less, the degree of crystallinity is not too high but is an appropriate value, whereby the fibers obtained by spinning do not undergo plastic deformation upon stretching, and high elastic recovery property is obtained.

The elastic nonwoven fabric A of the present invention has a crystallization temperature (Tc) measured with a differential scanning calorimeter (DSC) of from 20 to 100° C., and preferably from 20 to 90° C. Tc herein is an index showing the crystallization speed of the crystalline resin composition, and a higher value of Tc provides a larger crystallization speed of the crystalline resin composition. When Tc is 20° C. or more, the crystallization speed is not too small but is an appropriate value, whereby the yarns immediately after spinning are sufficiently solidified to prevent adhesion and shrinkage, thereby providing uniform yarns and nonwoven fabric. When Tc is 100° C. or less, the crystallization speed is suppressed, and the degree of crystallization is also suppressed associated therewith, whereby the fibers obtained by spinning has high elastic recovery property.

The Tc can be obtained as a peak top of a peak of an endothermic curve obtained in such a manner that 10 mg of a specimen is maintained at 220° C. for 5 minutes and decreased in temperature to −30° C. at 20° C. per minute in a nitrogen atmosphere with a differential scanning calorimeter (DSC-7, produced by Perkin-Elmer, Inc.).

In the elastic nonwoven fabric A of the present invention, the low crystalline polypropylene A satisfies the items (a) and (b) below. The items (a) and (b) can be controlled by the selection of the catalyst and the reaction conditions upon producing the low crystalline polypropylene A. The items (c) to (h) described later are the same.

(a) The melting point (Tm-D) is from 0 to 120° C., which is defined as a peak top of a peak observed on the highest temperature side of a melt endothermic curve obtained by maintaining at −10° C. for 5 minutes and increasing in temperature at 10° C. per minute in a nitrogen atmosphere with a differential scanning calorimeter (DSC).

When the melting point (Tm-D) of the low crystalline polypropylene A is 0° C. or more, the fibers obtained by spinning are suppressed from undergoing stickiness, and when it is 120° C. or less, sufficient elastic recovery property can be obtained. In consideration of the viewpoint, the melting point (Tm-D) is preferably from 0 to 100° C.

The melting point (Tm-D) can be obtained as a peak top of a peak observed on the highest temperature side of a melt endothermic curve obtained in such a manner that 10 mg of a specimen is maintained at −10° C. for 5 minutes and increased in temperature at 10° C. per minute in a nitrogen atmosphere with a differential scanning calorimeter (DSC-7, produced by Perkin-Elmer, Inc.).

(b) The stereoregularity index ([mm]) is from 50 to 90% by mol.

When the stereoregularity index ([mm]) is from 50% by mol or more, stickiness can be suppressed from occurring, and when it is 90% by mol of less, the operationality in the production process of the nonwoven fabric is improved. In consideration of the viewpoint, the stereoregularity index ([mm]) is preferably from 60 to 90% by mol, and more preferably from 60 to 80% by mol.

The stereoregularity index ([mm]) is a value obtained by measuring the meso triad fraction [mm] of the propylene chain by measuring $^{13}$C-NMR under the same conditions as those described later with JNM-EX400, produced by JEOL Ltd., described later. A larger value of the stereoregularity index ([mm]) provides higher stereoregularity.

The low crystalline polypropylene A preferably further satisfies the items (c) to (h) below.

(c) [mmmm]=20 to 60% by mol

When the meso pentad fraction [mmmm] of the low crystalline polypropylene A is 20% by mol or more, stickiness can be suppressed from occurring, and the solidification can be prevented from being delayed too much, whereby the nonwoven fabric can be prevented from being attached to or drawn to the calender roll or belt, thereby preventing continuous formation from being inhibited. When the meso pentad fraction [mmmm] is 60% by mol or less, the degree of crystallization is not too high, whereby good elastic recovery property is obtained. The meso pentad fraction [mmmm] is preferably from 30 to 50% by mol, and more preferably from 40 to 50% by mol.

The meso pentad fraction [mmmm], and the racemic pentad fraction [rrrr] and the racemic-meso-racemic-meso pentad fraction [rmrm] described later are the meso fraction, the racemic fraction and the racemic-meso-racemic-meso fraction, respectively, in terms of pentad unit in the polypropylene chain measured with the signal of methyl groups in the $^{13}$C-NMR spectrum according to the method proposed by A. Zambelli, et al., Macromolecules, No. 6, p. 925 (1973). A larger mesopentad fraction [mmmm] provides higher stereoregularity. The triad fractions [mm], [rr] and [mr] described later are also calculated in the aforementioned manner.

The measurement of $^{13}$C-NMR spectrum can be performed according to the attribution of peaks proposed by A. Zambelli, et al., Macromolecules, No. 8, p. 687 (1975) with the apparatus and condition shown below.

Equipment: $^{13}$C-NMR, Model JNM-EX400, produced by JEOL Ltd.

Method: proton complete decoupling method

Concentration: 220 mg/mL

Solvent: mixed solvent of 1,2,4-trichlorobenzene and deuterated benzene (90/10 by volume)

Temperature: 130° C.
Pulse width: 45°
Pulse repetition time: 4 sec
Accumulation: 10,000 times $$M=m/S\times100$$

$$R=\gamma/S\times100$$

$$S=P\beta\beta+P\alpha\beta+P\alpha\gamma$$ <Calculation Expression>

S: signal intensity of carbon atoms of side chain methyl of all propylene units
Pββ: 19.8-22.5 ppm
Pαβ: 18.0-17.5 ppm
Pαγ: 17.5-17.1 ppm
γ: racemic pentad chain: 20.7-20.3 ppm
m: meso pentad chain: 21.7-22.5 ppm (d) [rrrr]/(1−[mmmm])≤0.1

The value of [rrrr]/[1−mmmm] is obtained from the aforementioned fractions of the pentad units and is an index showing the extent of uniformity of the regularity distribution of the low crystalline polypropylene A. A larger value thereof provides a mixture of high regularity polypropylene and atactic polypropylene like ordinary polypropylene produced with a known catalyst system, such as magnesium-supported titanium catalyst, and thus causes stickiness.

When [rrrr]/(1−[mmmm]) of the low crystalline polypropylene A is 0.1 or less, a mixture of atactic polypropylene is not formed, and the fibers obtained by spinning are suppressed from undergoing stickiness. In consideration of the viewpoint, [rrrr]/(1−[mmmm]) is preferably 0.05 or less, and more preferably 0.04 or less.

(e) [rmrm]>2.5% by mol

When the racemic-meso-racemic-meso fraction [rmrm] of the low crystalline polypropylene A is a value exceeding 2.5% by mol, the low crystalline polypropylene A is increased in random property, and the fibers obtained by spinning are further improved in elastic recovery property. [rmrm] is preferably 2.6% by mol or more, and more preferably 2.7% by mol or more. The upper limit thereof is generally approximately 10% by mol.

(f) $[mm]\times[rr]/[mr]^2\leq2.0$ $[mm]\times[rr]/[mr]^2$ is an index of the random property of the low crystalline polypropylene A, and when the value is 2.0 or less, the fibers obtained by spinning have sufficient elastic recovery property and are suppressed from undergoing stickiness. When $[mm]\times[rr]/[mr]^2$ is close to 0.25, the random property is increased to provide better elastic recovery property. When the value is 2.0 or less, the fibers obtained by spinning have sufficient elastic recovery property and are suppressed from undergoing stickiness. From the viewpoint of providing sufficient elastic recovery property, $[mm]\times[rr]/[mr]^2$ is preferably more than 0.25 and 1.8 or less, and more preferably from 0.5 to 1.5.

(g) mass average molecular weight (Mw)=10,000 to 200,000

When the mass average molecular weight of the low crystalline polypropylene A is 10,000 or more, the viscosity of the low crystalline polypropylene A is not too low but is an appropriate value, whereby breakage of yarn upon spinning is suppressed from occurring. When the mass average molecular weight is 200,000 or less, the viscosity of the low crystalline polypropylene A is not too high to improve the spinning property. The mass average molecular weight is preferably from 30,000 to 150,000, and more preferably from 50,000 to 150,000. The measuring method of the mass average molecular weight will be described later.

(h) molecular weight distribution (Mw/Mn)<4

The molecular weight distribution (Mw/Mn) of the low crystalline polypropylene A is less than 4, the fibers obtained by spinning are suppressed from undergoing stickiness. The molecular weight distribution is preferably 3 or less.

The mass average molecular weight (Mw) is a polystyrene-conversion mass average molecular weight measured by the gel permeation chromatography (GPC) method with the apparatus and condition shown below, and the molecular weight distribution (Mw/Mn) is a value calculated from the number average molecular weight (Mn) measured similarly and the mass average molecular weight (Mw).

<GPC Measuring Equipment>
Column: Tosoh GMHHR-H(S)HT
Detector: RI detector for liquid chromatography, Waters 150 C
<Measurement Conditions>
Solvent: 1,2,4-trichlorobenzene
Measurement temperature: 145° C.
Flow rate: 1.0 mL/min
Specimen concentration: 2.2 mg/mL
Injection amount: 160 μL
Calibration line: Universal Calibration
Analysis software: HT-GPC (Ver. 1.0)

The low crystalline polypropylene A can be synthesized by using, for example, a homogeneous catalyst referred to as a metallocene catalyst disclosed in WO2003/087172. The high crystalline polypropylene used may be HF461Y (a trade name, produced by Basel Inc.) or the like, but it may be any propylene polymer exhibiting crystallinity without particular limitation. Examples thereof include a propylene homopolymer, a propylene random copolymer and a propylene block copolymer. The molecular weight of the high crystalline polypropylene is selected based on the moldability in any case. In the case of molding by the melt-blow method, such a material is preferred that has a melt flow rate (MFR) of approximately from 100 to 2,000 g per 10 minutes measured according to JIS K7210 at a temperature of 230° C. under a load of 21.18 N, and in the case of molding by the spunbond method, such a material is preferred that has an MFR of approximately from 10 to 100 g per 10 minutes. The molecular weight may be selected from the ranges depending on the purposes of the fibers and the nonwoven fabric. Specifically, in the purpose where the moldability is important, polypropylene having a high crystallization temperature and high crystallinity is preferred, and one having a crystallization temperature (Tc) of 100° C. or more is more preferred.

The crystalline resin composition for forming the elastic nonwoven fabric A of the present invention may contain, depending on necessity, various stabilizers, an ultraviolet ray absorbent, a thickening branching agent, a matting agent, a colorant, a softening agent, such as rubber, and other improvers. These may be added upon preparing the crystalline resin composition, and may be added upon producing the low crystalline polypropylene A or the high crystalline polypropylene.

The elastic nonwoven fabric A of the present invention can be obtained by producing from continuous filaments, partially oriented yarns (POY), bulk continuous filaments, or fine denier fibers, such as short fibers, produced with the crystalline resin composition; produced by the melt-blow method, the spunbond method or the like with the crystalline resin composition; or forming a nonwoven fabric laminated product by laminating nonwoven fabrics obtained by the melt-blow method or the spunbond method, and the production method may be appropriately selected depending on the purpose of the elastic nonwoven fabric A. The nonwoven fabric produced by the melt-blow method contains fibers having a small average diameter constituting the nonwoven fabric, and thus has good texture. The elastic nonwoven fabric A can be produced continuously by the spunbond method, and the elastic nonwoven fabric A produced by the spunbond method contains stretched continuous long fibers constituting the nonwoven fabric, and thus has large strength.

The fine denier fibers can be produced, for example, by extruding the crystalline resin composition through pores (nozzles) having a diameter of approximately from 0.3 to 0.8 mm in a metallic die. At this time, the crystalline resin composition preferably has a low melt viscosity, which can be attained by using the crystalline resin composition at a high melting temperature (from 230 to 280° C.) and a high melt flow rate (from 15 to 40 g per 10 minutes). An extruder having a relatively large size generally has a connecting part for feeding the molten resin to from 8 to 20 nozzles with high power. Respective spinheads generally regulate the production by being provided with separate gear pumps and have a filter package supported by the spinheads (breaker plates), and nozzle plates in the heads. The number of pores in the nozzle plate determines the number of filament within the yarn and varies depending on the demanded structure of the yarn, and the number is generally in a range of approximately from 20 to 250. The pores are generally grouped to a circular, annular or rectangular pattern for well distributing a cold air current.

(Continuous Filaments)

The yarn of the continuous filaments is generally in a range of from 40 to 2,000 denier (denier is a value in terms of gram per 9,000 yard). The filament may have from 1 to 20 denier per filament (dpf). The spinning speed is generally from 800 to 1,500 m/min. A representative method thereof is shown below. The filament is stretched at a stretching ratio of 3/1 or more (one-step stretching or two-step stretching) and wound on a package. A high stretching ratio is realized by two-step stretching. The winding speed is generally approximately from 2,000 to 3,500 m/min. At a stretching ratio exceeding 900 m/min, a crystalline resin composition having a narrow molecular weight distribution is preferably used for providing a thin filament with good spinning property maintained. Specifically, such a crystalline resin composition is preferably used that has an MFR of 5 g or more per 10 minutes, a narrow molecular weight distribution and a polydispersity index (PI) of 2.8 or less.

(Partially Oriented Yarn (POY))

The partially oriented yarn (POY) is a fiber that is formed directly by spinning without stretching in a solid state as in the aforementioned continuous filaments. The molecules of the fibers are stretched in a molten state immediately after the crystalline resin composition is discharged from the nozzle. The fibers are not stretched after solidifying the fibers and wound on a package. The POY has a tendency of having high elongation and low tensile strength in contrast to the yarn that is sufficiently stretched (FOY) having high tensile strength and low elongation.

(Bulk Continuous Filament)

Examples of the working process of the bulk continuous filaments include two basic processes, i.e., a one-step process and a two-step process. In the two-step process, for example, the non-stretched yarn is spun at less than 1,000 m/min, and generally less than 750 m/min, and arranged on a package. The yarn is generally stretched by two steps and formed into a "bulk form" on a machine referred to as a texturizer. The winding and stretching speeds are limited to 2,500 m/min or less by the bulking machine or the texturizer. Secondary crystallization requires quick stretching and spinning as similar to the two-step continuous filament process. The process that is most general in the current state is the step of one-step spinning/stretching/weaving (SDT). This process is excellent in economy, efficiency and quality as compared to the two-step process, and is similar to the one-step continuous filament process except that the bulking machine is disposed in series. Bulking or spinning changes the appearance of the yarn and imparts sufficiently loose bend and wrinkle with separation of yarns, and thus the yarns appear thicker (bulky).

(Short Fibers)

Examples of the short fiber spinning process include a conventional spinning method and compact spinning. The conventional spinning process generally includes two steps, i.e., (1) production and finishing steps and winding, and subsequently (2) stretching and second finishing steps, crimping, and cutting into short fibers. As the filament, one of from 1.5 to 70 dpf is used depending on the purpose. The length of the short fibers may be as short as approximately 7 mm and as long as 200 mm depending on the purposes. The fibers are crimped in many purposes. The crimping is attained by feeding tow excessively to a box heated with steam by using a pair of nip rollers. By excessive feeding, the tow is folded in the box to form bend or crimp of the filament. The bend is heat-set with steam injected into the box. The molecular weight, the molecular weight distribution and the isotactic content of the resin all influence on the stability and magnitude of crimping and easiness on crimping.

(Melt-Blow Method)

A known method may be used as the melt-blow method. For example, the crystalline resin composition having been melt kneaded is extruded from nozzles and is made in contact with a heated gas flow at a high speed to form fine fibers, and the fine fibers are collected to a porous support to form a nonwoven fabric, which is subjected to a heat fusing process depending on necessity, thereby producing the elastic nonwoven fabric A. The average fiber diameter of the fibers forming the melt-blown nonwoven fabric is approximately from 0.1 to 20 μm, preferably from 1 to 30 μm, and more preferably from 2 to 10 μm. The nonwoven fabric produced by the melt-blow method has a small average diameter of the fibers constituting the nonwoven fabric, and thus has excellent barrier property and good texture.

As a specific process of melt-blowing, for example, the crystalline resin composition melted in an extruder is transported to a metering melting pump, and the molten crystalline resin composition is fed to a special melt injection mold at a stable production speed with the melting pump. The molten crystalline resin composition discharged from the mold is made in contact with a high-temperature and high-speed air flow. The high-temperature and high-speed air flow stretches the filament and solidifies the filament along with cooling air. The aforementioned entire fiber forming process is generally performed in the vicinity within several inches of the mold. The design of the mold is important for producing a product efficiently with good quality. A cloth is formed by spraying the filaments directly onto the porous forming belt, and the distance between the nozzle and the porous forming belt is generally from 200 to 400 mm. For providing fibers as thin as possible, it is demanded to use the crystalline resin composition that has an extremely high MFR of 200 g per 10 minutes or more, and the crystalline resin composition that has a low MFR of approximately 20 g per 10 minutes may be used at a higher processing temperature.

(Spunbond Method)

In the spunbond method, the crystalline resin composition having been melt-kneaded is spun, stretched and filamentized to form continuous long fibers, and in the subsequent continuous process, the continuous long fibers are accumulated and entwined on the movable collecting surface, thereby forming the elastic nonwoven fabric A. In the spunbond method, the elastic nonwoven fabric A can be produced continuously, and the elastic nonwoven fabric A produced by the spunbond method has large strength since the stretched continuous long fibers are used as the fibers constituting the nonwoven fabric.

A known method may be used as the spunbond method. For example, fibers can be produced by extruding a molten polymer through a large nozzle having several thousands of pores or a group of small nozzles having approximately 40 pores. The molten fibers after being discharged from the nozzle are cooled with a cross flow air cooling system, and then drawn away from the nozzle and stretched with high-speed air. In general, there are two kinds of air attenuating methods, and both the methods utilize the Venturi effect. In the first method, filaments are stretched with a suction slot (slot stretching) within the width of the nozzle or the width of the machine. In the second method, filaments are stretched through a nozzle or a suction gun. The filaments formed by the methods are collected on a screen (wire) or a fine pore belt to form a web. The web is passed through a compression roller and then through a heating calender roller to form a nonwoven fabric by bonding on the bulge part of one roller having from 10 to 40% in area of the web.

(Nonwoven Fabric Laminated Product)

A spunbond nonwoven fabric (S) obtained by the spunbond method and a melt-blown nonwoven fabric (M) obtained from the crystalline resin composition may be laminated. A nonwoven fabric laminated product having an SM structure containing a spunbond nonwoven fabric layer and a melt-blown nonwoven fabric layer with the S layer containing at least one pair of spunbond nonwoven fabrics exhibits excellent flexibility. The SM structure may be repeated. The laminated product may have a structure containing at least one melt-blown nonwoven fabric (M) obtained from the crystalline resin composition having on both sides thereof layers of a spunbond nonwoven fabric (S). In other words, the nonwoven fabric laminated product may have an SMS structure containing a spunbond nonwoven fabric layer/a melt-blown nonwoven fabric layer/a spunbond nonwoven fabric layer, and the structure may be repeated. The SMS nonwoven fabric laminated product is preferred from the standpoint of balance between strength and flexibility of the laminated product. The areal weight of the SMS is generally from 7 to 100 g/m$^2$, preferably from 10 to 70 g/m$^2$, and further preferably from 10 to 50 g/m$^2$.

The production method of the nonwoven fabric laminated product may be any method without particular limitation as far as the method integrates the spunbond nonwoven fabric and the melt-blown nonwoven fabric to form a laminated product. For example, such methods may be employed as a method, in which fibers formed by the melt-blow method are accumulated directly on a spunbond nonwoven fabric to form a melt-blown nonwoven fabric, and then the spunbond nonwoven fabric and the melt-blown nonwoven fabric are fused to each other; a method, in which a spunbond nonwoven fabric and a melt-blown nonwoven fabric are superimposed on each other, and both the nonwoven fabrics are fused to each other with heat and pressure; and a method, in which a spunbond nonwoven fabric and a melt-blown nonwoven fabric are adhered to each other with an adhesive, such as a hot-melt adhesive and a solvent adhesive.

The method of forming a melt-blown nonwoven fabric directly on a spunbond nonwoven fabric can be performed by the melt-blow method of spraying a molten product of the crystalline resin composition on the surface of a spunbond nonwoven fabric, thereby accumulating fibers thereon. At this time, by making negative pressure on the side of the surface of the spunbond nonwoven fabric opposite to the surface having the fibers accumulated, the fibers formed by the melt-blow method are sprayed and accumulated, and simultaneously the spunbond nonwoven fabric and the melt-blown nonwoven fabric are integrated, thereby providing a flexible nonwoven fabric laminated product having a spunbond nonwoven fabric layer and a melt-blown nonwoven fabric layer. In the case where both the nonwoven fabrics are insufficiently integrated, they may be sufficiently integrated with an embossing roller under heat and pressure, or the like.

Examples of the method of fusing a spunbond nonwoven fabric and a melt-blown nonwoven fabric by heat fusing include a method of heat-fusing the entire contact surface of the spunbond nonwoven fabric and the melt-blown nonwoven fabric, and a method of heat-fusing a part of the contact surface of the spunbond nonwoven fabric and the melt-blown nonwoven fabric. In the present invention, the spunbond nonwoven fabric and the melt-blown nonwoven fabric are preferably heat-fused by a heat embossing process, and the fused area in this case is from 5 to 35%, and preferably from 10 to 30%, of the contact area between the spunbond nonwoven fabric and the melt-blown nonwoven fabric. When the fused area is in the range, the flexible nonwoven fabric laminated product is excellent in peeling strength and flexibility.

Examples of the hot-melt adhesive used in the method of adhering a spunbond nonwoven fabric and a melt-blown nonwoven fabric with adhesive include a resin adhesive, such as a vinyl acetate series and a polyvinyl alcohol series, and a rubber adhesive, such as a styrene-butadiene series and a styrene-isoprene series. Examples of the solvent adhesive include a rubber adhesive, such as a styrene-butadiene series, a styrene-isoprene series and an urethane series, and an organic solvent or aqueous emulsion series resin adhesive, such as vinyl acetate and vinyl chloride. Among these adhesives, a rubber hot-melt adhesive, such as a styrene-isoprene series and a styrene-butadiene series, is preferred since the texture, which is a characteristic feature of the spunbond nonwoven fabric, is not impaired.

(Annealing)

The elastic nonwoven fabric A of the present invention excellent in stretchability and elasticity can be produced by performing an annealing process in addition to the aforementioned methods.

For the continuous filament, annealing may be performed after forming the fibers or after producing a nonwoven fabric from the fibers. The annealing relaxes partially the internal stress of the stretched fibers, thereby recovering the elastic recovery property of the crystalline resin composition in the fibers. The annealing considerably changes the internal crystalline structure and the relative order of the amorphous and semicrystalline phases, thereby recovering the elastic property. For example, annealing of fibers at a temperature of 40° C. or more and slightly lower than the crystal melting point of the crystalline resin composition is suitable for recovering the elastic property of the fibers.

The heat annealing of the crystalline resin composition is performed by maintaining the crystalline resin composition or a material formed from the composition, for example, at a temperature of from room temperature to 160° C. or from room temperature to 130° C. for a period of time of from several seconds to 1 hour. The annealing time is generally from 1 to 5 minutes at 100° C. The annealing time and temperature may be controlled depending on the crystalline resin composition. The annealing temperature may be in a range of from 60 to 130° C. and may be approximately 100° C. In some cases, for example, the conventional continuous spinning and annealing may be performed by passing the fibers through a heating roller, but the conventional annealing technique may not be applied. The annealing should be performed at an extremely low fiber tension to make the fibers shrunk from the standpoint of imparting elasticity to the fibers. In the process of a nonwoven fabric, the web is generally passed through calender to attain point binding (strengthening) the web. The fibers are annealed by passing the non-strengthened nonwoven fabric through heating calender at a relatively high temperature, thereby enhancing the elasticity of the nonwoven fabric web. As similar to the fiber annealing, for enhancing the elasticity of the nonwoven fabric web, the nonwoven fabric web should be enabled in shrinkage in both the machine direction (MD) and the crosswise direction (CD) under low tension. The boding calender roller temperature is, for example, from 100 to 130° C. and may be approximately 100° C. The annealing temperature may be controlled depending on the crystalline resin composition.

The fibers thus obtained may be used directly as naked yarn or may be used as coated elastic fibers after coating with other fibers, such as conventional fibers, e.g., polyamide fibers, wool, cotton, regenerated fibers and polyester fibers, for such applications as tights, a pantyhose, a body foundation, a garter, a rubber edge, a corset, a surgical bandage, a fabric or knit swimsuit and sporting wear.

Examples of the fiber product using the elastic nonwoven fabric A of the present invention include the following fiber products without particular limitation. Examples thereof include a member for a disposable diaper, such as a side bandage and a gather tape, a stretchable member for a diaper holder, a stretchable member for a sanitary product, a stretchable member of a hygienic product, a stretchable tape, an adhesive plaster, a stretchable member for clothing, an insulating material for clothing, a heat insulating material for clothing, a protective suit, a headwear, a face mask, a glove, a supporting bandage, a stretchable bandage, a base cloth or the like of an analgesic plaster, a member demanded to have stretchability, air permeability and following property to the human body, an antislipping base cloth, a vibration absorbing material, a fingerstall, an air filter for a clean room, an electret filter with electret treatment, a separator, a heat insulator, a coffee bag, a food packaging material, various automobile materials, such as a ceiling surface material for an automobile, an acoustic insulating material, a cushioning material, a dust proof material for a speaker, an air cleaner material, a surface material for an insulator, a backing material, an adhesive nonwoven fabric sheet and various members for automobiles, such as a door trim, various cleaning material, such as a cleaning material for a duplicator, a surface material and a backing material for carpet, an agricultural rolled cloth, a wood drain, a member for shoes, such as a surface material for sporting shoes, a member for a bag, an industrial sealing material, a wiping material, a base material for artificial leather, a bed sheet, a bag, furniture, an interior material, a seat for an automobile, apparel, a stretchable protective cover, a packaging material, a poultice material, a stretchable tape, a supporting bandage, a glove, an outer wear and an underwear.

<Second Invention>

The elastic nonwoven fabric according to the second invention of the present invention (which may be hereinafter referred to as an elastic nonwoven fabric B) is produced by using a crystalline resin composition containing low crystalline polypropylene satisfying items (c) to (h) below (which may be hereinafter referred to as low crystalline polypropylene B), and a releasing agent. The crystalline polypropylene in the present invention is polypropylene that has the melting point (Tm-D) described later observed. The low crystalline polypropylene B is crystalline polypropylene that has a melting point of from 0 to 120° C.

The following conditions (c) to (h) can be controlled by the selection of the catalyst and the reaction conditions upon producing the low crystalline polypropylene B. The items (a) and (b) described later are the same.

(c) [mmmm]=20 to 60% by mol (d) $[rrrr]/(1-[mmmm])\leq 0.1$ (e) [rmrm]>2.5% by mol (f) $[mm]\times[rr]/[mr]^2\leq 2.0$ (g) mass average molecular weight (Mw)=10,000 to 200,000

(h) molecular weight distribution (Mw/Mn)<4

The details of the items (c) to (h) are the same as the items (c) to (h) that have been described for the conditions that are preferably satisfied by the low crystalline polypropylene A in the elastic nonwoven fabric A according to the first invention of the present invention.

In the elastic nonwoven fabric B of the present invention, the low crystalline polypropylene B preferably satisfies the items (a) and (b) below.

(a) The melting point (Tm-D) is from 0 to 120° C., which is defined as a peak top of a peak observed on the most high temperature side of a melt endothermic curve obtained by maintaining at −10° C. for 5 minutes and increasing in temperature at 10° C. per minute in a nitrogen atmosphere with a differential scanning calorimeter (DSC).

(b) The stereoregularity index ([mm]) is from 50 to 90% by mol.

When the stereoregularity index ([mm]) is from 50% by mol or more, stickiness can be suppressed from occurring, and when it is 90% by mol of less, the operationality in the production process of the nonwoven fabric is improved. In consideration of the viewpoint, the stereoregularity index ([mm]) is preferably from 60 to 90% by mol, and more preferably from 60 to 80% by mol.

The details of the items (a) and (b) are the same as the items (a) and (b) that have been described for the conditions that are satisfied by the low crystalline polypropylene A in the elastic nonwoven fabric A according to the first invention of the present invention.

The low crystalline polypropylene B can be synthesized by using, for example, a homogeneous catalyst referred to as a metallocene catalyst disclosed in WO2003/087172.

The releasing agent used in the production of the elastic nonwoven fabric B of the present invention is an additive that improves releasing property for preventing the thus-formed nonwoven fabric from being adhered to a roller or a conveyer of a molding machine. The releasing agent that is contained in the crystalline resin composition is referred to as an internal releasing agent, and the internal releasing agent is an additive that improves the releasing property of the nonwoven fabric by adding to the resin raw materials. An external releasing agent described later is an additive that improves the releasing property of the nonwoven fabric by applying directly to a roller or a conveyer of a molding machine.

Examples of the internal releasing agent include the following.

(1) A high melting point polymer, an organic carboxylic acid or a metal salt thereof, an aromatic sulfonate salt or a metallic salt thereof, an organic phosphoric acid compound or a metallic salt thereof, dibenzylidene sorbitol or a derivative thereof, a partial metallic salt of rosin acid, inorganic fine particles, imide acid, amide acid, a quinacridone compound, a quinone compound, and mixtures of these compounds.

(a) High melting point polymer

Polyolefin, such as polyethylene and polypropylene, and the like.

(b) Metallic salt

Examples thereof include aluminum benzoate, aluminum p-t-butylbenzoate, sodium adipate, sodium thiophenecarboxylate, sodium pyrrolecarboxylate and the like, and a metallic soap, which is a metallic salt of a carboxylic acid. Examples of the metal include Li, Ca, Ba, Zu, Mg, Al and Pb, and examples of the carboxylic acid include a fatty acid, such as octylic acid, palmitic acid, lauric acid, stearic acid, behenic acid, montanic acid, 12-hydroxystearic acid, oleic acid, isostearic acid and ricinoleic acid, and an aromatic acid, such as benzoic acid and p-t-butylbenzoic acid.

(c) Dibenzylidene sorbitol or derivative thereof.

Dibenzylidene sorbitol, 1,3:2,4-bis(o-3,4-dimethylbenzylidene) sorbitol, 1,3:2,4-bis(o-2,4-dimethylbenzylidene) sorbitol, 1,3:2,4-bis(o-4-ethylbenzylidene) sorbitol, 1,3:2,4-bis(o-4-chlorobenzylidene) sorbitol, 1,3:2,4-dibenzylidene sorbitol and the like, and specifically, Gel All MD, Gel All MD-R and the like, produced by New Japan Chemical Co., Ltd., and the like.

(d) Partial metallic salt of rosin acid

Pinecrystal KM1600, Pinecrystal KM1500, Pinecrystal 1300 and the like, produced by Arakawa Chemical Industries, Ltd., and the like.

(e) Inorganic fine particles

Talc, clay, mica, asbestos, glass fibers, glass flakes, glass beads, calcium silicate, montmorillonite, bentonite, graphite, aluminum powder, alumina, silica, diatomaceous earth, titanium oxide, magnesium oxide, pumice powder, pumice balloons, aluminum hydroxide, magnesium hydroxide, basic magnesium carbonate, dolomite, calcium sulfate, potassium titanate, barium sulfate, calcium sulfite, molybdenum sulfide and the like.

(f) Amide compound

Adipic acid dianilide, suberic acid dianilide and the like.

(g) Organic phosphoric acid metallic salt

Adeka Stab NA-11 and Adeka Stab NA-21, produced by Adeka Corporation, and the like.

(2) Synthesized silica

Sylysia, produced by Fuji Silysia Chemical, Ltd., Mizukasil, produced by Mizusawa Industrial Chemicals, Ltd., and the like.

(3) Erucic acid amide, oleic acid amide, stearic acid amide, behenic acid amide, ethylenebisstearic acid amide, ethylenebisoleic acid amide, stearylerucic acid amide, oleylpalmitoamide and the like.

The internal releasing agents may be used solely or as a combination of two or more kinds thereof. In the present invention, dibenzylidene sorbitol, 1,3:2,4-bis(o-3,4-dimethylbenzylidene) sorbitol, 1,3:2,4-bis(o-2,4-dimethylbenzylidene) sorbitol, 1,3:2,4-bis(o-4-ethylbenzylidene) sorbitol, 1,3:2,4-bis(o-4-chlorobenzylidene) sorbitol and 1,3:2,4-dibenzylidene sorbitol are preferred among the internal releasing agents.

In the crystalline resin composition for producing the elastic nonwoven fabric B of the present invention, the content of the internal releasing agent is preferably from 10 to 10,000 ppm by mass, and more preferably from 100 to 5,000 ppm by mass, based on the resin composition. When the content of the internal releasing agent is 10 ppm by mass or more, the function of the releasing agent is exhibited, and when it is 10,000 ppm by mass or less, the function of the releasing agent and the economy are well balanced.

Various additives may be added depending on necessity to the crystalline resin composition for producing the elastic nonwoven fabric B of the present invention. Examples of the additives include an antioxidant, a neutralizing agent, a slipping agent, an antiblocking agent, an antifoggant and an antistatic agent. The additives may be used solely or as a combination of two or more kinds thereof. For example, examples of the antioxidant include a phosphorus antioxidant, a phenol antioxidant and a sulfur antioxidant. These may be added upon preparing the crystalline resin composition, or may be added upon producing the low crystalline polypropylene B.

The elastic nonwoven fabric B of the present invention can be produced by such a method as the melt-blow method and a spunbond method, and the production method may be appropriately selected depending on the purpose of the elastic nonwoven fabric B.

In the melt-blow method, a molten product of the crystalline resin composition is extruded from nozzles and is made in contact with a heated gas flow at a high speed to form fine fibers, and the fine fibers are collected to a movable collecting surface to form a nonwoven fabric, thereby producing the elastic nonwoven fabric B. The nonwoven fabric produced by the melt-blow method has a small average diameter of the fibers constituting the nonwoven fabric, and thus has good texture.

In the spunbond method, the crystalline resin composition having been melt-kneaded is spun, stretched and filamentized to form continuous long fibers, and in the subsequent continuous process, the long fibers are accumulated and entwined on the movable collecting surface, thereby forming the elastic nonwoven fabric B. In the spunbond method, the elastic nonwoven fabric B can be produced continuously, and the elastic nonwoven fabric B produced by the spunbond method has large strength since the stretched continuous long fibers are used as the fibers constituting the nonwoven fabric.

In the case where the external releasing agent is used upon producing the elastic nonwoven fabric B of the present invention, the external releasing agent is dispersed on the movable collecting surface. In the case where the crystalline resin composition for producing the elastic nonwoven fabric B contains the internal releasing agent, the external releasing agent may not be dispersed on the movable collecting surface, but the external releasing agent may be dispersed on the movable collecting surface upon producing the elastic nonwoven fabric B for providing good releasing property.

Examples of the external releasing agent include a fluorine releasing agent and a silicone releasing agent. Examples of the fluorine releasing agent include Daifree, produced by Daikin Industries, Ltd. and Frelease, produced by Neos Co., Ltd. Examples of the silicone releasing agent include SPRAY 200, produced by Dow Corning Toray Silicone Co., Ltd., KF96SP, produced by Shin-Etsu Chemical Co., Ltd., Epolease 96, Nippon Pelnox Corporation, and KURE-1046, produced by Kure Engineering, Ltd. These may be used solely or as a combination of two or more kinds thereof. In the present invention, a silicone releasing agent is preferred among the external releasing agents.

Examples of a method for dispersing the external releasing agent on the collecting surface include a method of spraying.

The fiber product using the elastic nonwoven fabric B of the present invention is not particularly limited, and examples thereof include those described as the fiber products using the elastic nonwoven fabric A according to the first invention of the present invention.

<Third Invention>

The elastic nonwoven fabric according to the third invention of the present invention (which may be hereinafter referred to as an elastic nonwoven fabric C) contains core/shell type composite fibers containing low crystalline polypropylene having particular characteristics (which may be hereinafter referred to as low crystalline polypropylene C).

In the present description, the core/shell type composite fibers are fibers have a cross section including a "core" as the center part and a "shell" as an outer layer. The crystalline polypropylene is polypropylene that has a melting point observed in the following measurement with a differential scanning calorimeter (DSC), the high crystalline polypropylene is crystalline polypropylene having a melting point of 155° C. or more, and the low crystalline polypropylene is crystalline polypropylene having a melting point of from 0 to 120° C.

The melting point (Tm-D) is defined as a peak top of a peak observed on the most high temperature side of a melt endothermic curve obtained by maintaining at −10° C. for 5 minutes and increasing in temperature at 10° C. per minute in a nitrogen atmosphere with a differential scanning calorimeter (DSC).

[Low Crystalline Polypropylene C]

The low crystalline polypropylene C used in the present invention has the properties shown in the items (c) to (h) below, which can be controlled by the selection of the catalyst and the reaction conditions upon producing the low crystalline polypropylene C.

(c) [mmmm]=20 to 60% by mol (d) [rrrr]/(1−[mmmm])≤0.1

(e) [rmrm]>2.5% by mol (f) $[mm]\times[rr]/[mr]^2\leq 2.0$ (g) mass average molecular weight (Mw)=10,000 to 200,000

(h) molecular weight distribution (Mw/Mn)<4

The details of the items (c) to (h) are the same as the items (c) to (h) that have been described for the conditions that are preferably satisfied by the low crystalline polypropylene A in the elastic nonwoven fabric A according to the first invention of the present invention.

The low crystalline polypropylene C can be synthesized by using, for example, a metallocene catalyst disclosed in WO2003/087172. In particular, a catalyst that contains a transitional metal compound having a ligand forming a crosslinked structure through a bridge group is preferred, and a metallocene catalyst that is obtained by combining a transition metal compound having a crosslinked structure through two bridge groups with a co-catalyst is further preferred.

Specific examples thereof include (A) a transition metal compound represented by the general formula (I):

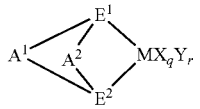

(I)

(wherein M represents a metallic element of Groups 3 to 10 or lanthanoide series in the periodic table; $E^1$ and $E^2$ each represent a ligand selected from a substituted cyclopentadienyl group, an indenyl group, a substituted indenyl group, a heterocyclopentadienyl group, a substituted heterocyclopentadienyl group, an amide group, a phosphide group, a hydrocarbon group and a silicon-containing group, forms a crosslinked structure through $A^1$ and $A^2$, and may be the same or different; X represents a σ-bonding ligand, and when there are plural X, the plural X may be the same or different, and may be crosslinked to the other X, $E^1$, $E^2$ or Y; Y represents a Lewis base, and when there are plural Y, the plural Y may be the same or different, and may be crosslinked to the other Y, $E^1$, $E^2$ or X; $A^1$ and $A^2$ each represent a divalent crosslinking group bonding two ligands, each represent a hydrocarbon group having from 1 to 20 carbon atoms, a halogen-containing hydrocarbon group having from 1 to 20 carbon atoms, a silicon-containing group, a germanium-containing group, a tin-containing group, —O—, —CO—, —S—, —$SO_2$—, —Se—, —$NR^1$—, —$PR^1$—, —P(O)$R^1$—, —$BR^1$— or —Al$R^1$—, wherein $R^1$ represents a hydrogen atom, a halogen atom, a hydrocarbon group having from 1 to 20 carbon atoms or a halogen-containing hydrocarbon group having from 1 to 20 carbon atoms, and may be the same or different; q represents an integer of from 1 to 5, which is ((atomic valence of M)−2); and r represents an integer of from 0 to 3,) and (B) (B-1) a compound that is capable of forming an ionic complex through reaction with the transition metal compound as the component (A) or a derivative thereof, and (B-2) a polymerization catalyst containing a component selected from aluminoxane.

The transition metal compound as the component (A) is preferably a transition metal compound having a (1,2')(2,1') double-crosslinked ligand, and examples thereof include (1,2'-dimethylsilylene)(2,1'-dimethylsilylene)-bis(3-trimethylsilylmethylindenyl)zirconium dichloride.

Specific examples of the compound as the component (B-1) include triethylammonium tetraphenylborate, tri-n-butylammonium tetraphenylborate, trimethylammonium tetraphenylborate, tetraethylammonium tetraphenylborate, methyl(tri-n-butyl)ammonium tetraphenylborate, benzyl(tri-n-butyl) ammonium tetraphenylborate, dimethyldiphenylammonium tetraphenylborate, triphenyl(methyl)ammonium tetraphenylborate, trimethylanilinium tetraphenylborate, methylpyridinium tetraphenylborate, benzylpyridinium tetraphenylborate, methyl(2-cyanopyridinium) tetraphenylborate, triethylammonium tetrakis(pentafluorophenyl)borate, tri-n-butylammonium tetrakis(pentafluorophenyl)borate, triphenylammonium tetrakis (pentafluorophenyl)borate, tetra-n-butylammonium tetrakis (pentafluorophenyl)borate, tetraethylammonium tetrakis (pentafluorophenyl)borate, benzyl(tri-n-butyl)ammonium tetrakis(pentafluorophenyl)borate, methyldiphenylammonium tetrakis(pentafluorophenyl)borate, triphenyl(methyl) ammonium tetrakis(pentafluorophenyl)borate, methylanilinium tetrakis(pentafluorophenyl)borate, dimethylanilinium tetrakis(pentafluorophenyl)borate, trimethylanilinium tetrakis(pentafluorophenyl)borate, methylpyridinium tetrakis(pentafluorophenyl)borate, benzylpyridinium tetrakis(pentafluorophenyl)borate, methyl(2-cycnopyridinium) tetrakis(pentafluorophenyl)borate, benzyl (2-cyanopyridinium) tetrakis(pentafluorophenyl)borate, methyl(4-cyanopyridinium) tetrakis(pentafluorophenyl)borate, triphenylphosphonium tetrakis(pentafluorophenyl)borate, dimethylanilinium tetrakis(bis(3,5-ditrifluoromethyl) phenyl)borate, ferrocenium tetraphenylborate, silver tetraphenylborate, trityl tetraphenylborate, tetraphenylporphyrin manganese tetraphenylborate, ferrocenium tetrakis (pentafluorophenyl)borate, (1,1'-dimethylferrocenium) tetrakis(pentafluorophenyl)borate, decamethylcerrocenium tetrakis(pentafluorophenyl)borate, silver tetrakis(pentafluorophenyl)borate, trityl tetrakis(pentafluorophenyl)borate, lithium tetrakis(pentafluorophenyl)borate, sodium tetrakis (pentafluorophenyl)borate, tetraphenylporphyrin manganese tetrakis(pentafluorophenyl)borate, silver tetrafluoroborate, silver hexafluoroborate, silver hexafluoroarsenate, silver perchlorate, silver trifluoroacetate and silver trifluoromethanesulfonate.

Examples of the aluminoxane as the component (B-2) include a known linear aluminoxane and a known cyclic aluminoxane.

The low crystalline polypropylene C may be produced by using in combination an organic aluminum compound, such as trimethylaluminum, triethylaluminum, triisopropylaluminum, triisobutylaluminum, dimethyaluminum chloride, diethylaluminum chloride, methylaluminum chloride, ethylaluminum dichloride, dimethylaluminum fluoride, diisobutylaluminum hydride, diethylaluminum hydride and ethylaluminum sesquichloride.

[High Crystalline Polypropylene]

As the high crystalline polypropylene used in the present invention, Y2000GP (a trade name, produced by Prime Polymer Co., Ltd.) and the like may be used, but it may be any crystalline polypropylene that has a melting point of 155° C. or more without particular limitation. Examples thereof include a propylene homopolymer, a propylene random copolymer and a propylene block copolymer. The molecular weight of the high crystalline polypropylene is selected based on the moldability in any case. In the case of molding by the melt-blow method, such a material is preferred that has a melt flow rate (MFR) of approximately from 100 to 2,000 g per 10 minutes measured according to JIS K7210 at a temperature of 230° C. under a load of 21.18 N, and in the case of molding by the spunbond method, such a material is preferred that has an MFR of approximately from 10 to 100 g per 10 minutes. The molecular weight may be selected from the ranges depending on the purposes of the fibers and the nonwoven fabric. Specifically, in the purpose where the moldability is important, polypropylene having a high crystallization temperature and high crystallinity is preferred, and one having a crystallization temperature (Tc) of 100° C. or more is more preferred.

[Core/Shell Type Composite Fibers]

1. Shell Component

The shell component of the core/shell type composite fibers preferably contains the low crystalline polypropylene C and the high crystalline polypropylene, and the contents of the components are preferably from 50 to 99% by Mass for the low crystalline polypropylene C and from 1 to 50% by mass for the high crystalline polypropylene, more preferably from 60 to 95% by mass for the low crystalline polypropylene C and from 5 to 40% by mass for the high crystalline polypropylene, and further preferably from 60 to 90% by mass for the low crystalline polypropylene C and from 10 to 40% by mass for the high crystalline polypropylene. When the low crystalline polypropylene C is 50% by mass or less, sufficient elastic recovery property is obtained, when it is 99% by mass or less, attachment to the calender roller is suppressed to improve the continuous moldability.

An internal releasing agent may be added to the shell component in the present invention. The internal releasing agent is an additive that improves the releasing property of the nonwoven fabric by adding to the resin raw materials, and specific examples thereof include a high melting point polymer, an organic carboxylic acid or a metal salt thereof, an aromatic sulfonic acid or a metallic salt thereof, an organic phosphoric acid compound or a metallic salt thereof, dibenzylidene sorbitol or a derivative thereof, a partial metallic salt of rosin acid, inorganic fine particles, an imide acid compound, an amide acid compound, a quinacridone compound, a quinone compound, and mixtures of these compounds.

Examples of the high melting point polymer include polyolefin, such as polyethylene and polypropylene.

Examples of the organic carboxylic acid include a fatty acid, such as octylic acid, palmitic acid, lauric acid, stearic acid, behenic acid, montanic acid, 12-hydroxystearic acid, oleic acid, isostearic acid and ricinoleic acid, and an aromatic carboxylic acid, such as benzoic acid and p-t-butylbenzoic acid. Examples of the metallic acid of the organic carboxylic acid include salts of Li, Ca, Ba, Zu, Mg, Al, Pb and the like, and a metallic soap, which is a metallic salt of a carboxylic acid, and specific examples thereof include aluminum benzoate, aluminum p-t-butylbenzoate, sodium adipate, sodium thiophenecarboxylate and sodium pyrrolecarboxylate.

Examples of the aromatic sulfonic acid include a linear alkylbenzenesulfonic acid, a branched alkylbenzenesulfonic acid, napthalenesulfonic acid and dodecylbenzenesulfonic acid, and examples of the metallic salt of an aromatic sulfonic acid include salts of Li, Ca, Ba, Zu, Mg, Al, Pb and the like of the aromatic sulfonic acids.

Examples of the organic phosphoric acid compound include trimethyl phosphate, triethyl phosphate, tributyl phosphate, 2-ethylhexyl phosphate, butoxyethyl phosphate, triphenyl phosphate, tricresyl phosphate, trixylylenyl phosphate, cresyldiphenyl phosphate, 2-ethylhexyldiphenyl phosphate, cresyl-2,6-xylylenyl phosphate, resorcinoldiphenol phosphate, various kinds of aromatic condensed phosphate esters, 2-chloroethyl phosphate, chloropropyl phosphate, dichloropropyl phosphate, tribromoneopentyl phosphate, a halogen-containing condensed phosphoric acid, bis-2-ethylhexyl phosphate, diisodecyl phosphate, 2-methacryloyloxyethyl acid phosphate, diphenyl-2-methacryloyloxyethyl phosphate, methyl acid phosphate, butyl acid phosphate, monoisodecyl phosphate, 2-butylhexyl acid phosphate, isodecyl acid phosphate, triphenyl phosphate, dibutyl hydrogen phosphate, dibutyl hydrogen phosphate, polyoxyethylene lauryl ether phosphoric acid, polyoxyalkyl ether phosphoric acid, polyoxyethylene alkylphenyl ether phosphoric acid and polyoxyethylene dialkylphenyl ether phosphoric acid, and examples of the metallic salt of an organic phosphoric acid compound include salts of Li, Ca, Ba, Zu, Mg, Al, Pb and the like of the aforementioned organic phosphoric acid compounds. Examples of the commercially available products thereof include Adeka Stab NA-11 and Adeka Stab NA-21, produced by Adeka Corporation.

Examples of the dibenzylidene sorbitol or a derivative thereof include dibenzylidene sorbitol, 1,3:2,4-bis(o-3,4-dimethylbenzylidene) sorbitol, 1,3:2,4-bis(o-2,4-dimethylbenzylidene) sorbitol, 1,3:2,4-bis(o-4-ethylbenzylidene)

sorbitol, 1,3:2,4-bis(o-4-chlorobenzylidene) sorbitol and 1,3:2,4-benzylidene sorbitol, and examples of the commercially available products thereof include Gel All MD and Gel All MD-R, produced by New Japan Chemical Co., Ltd.

Examples of the partial metallic salt of rosin acid include Pinecrystal KM1600, Pinecrystal KM1500 and Pinecrystal 1300, produced by Arakawa Chemical Industries, Ltd.

Examples of the inorganic fine particles include talc, clay, mica, asbestos, glass fibers, glass flakes, glass beads, calcium silicate, montmorillonite, bentonite, graphite, aluminum powder, alumina, silica, diatomaceous earth, titanium oxide, magnesium oxide, pumice powder, pumice balloons, aluminum hydroxide, magnesium hydroxide, basic magnesium carbonate, dolomite, calcium sulfate, potassium titanate, barium sulfate, calcium sulfite and molybdenum sulfide. Examples of the commercially available products thereof include sylysia, produced by Fuji Silysia Chemical, Ltd., and Mizukasil, produced by Mizusawa Industrial Chemicals, Ltd.

The internal releasing agents may be used solely or as a combination of two or more kinds thereof. In the present invention, dibenzylidene sorbitol, 1,3:2,4-bis(o-3,4-dimethylbenzylidene) sorbitol, 1,3:2,4-bis(o-2,4-dimethylbenzylidene) sorbitol, 1,3:2,4-bis(o-4-ethylbenzylidene) sorbitol, 1,3:2,4-bis(o-4-chlorobenzylidene) sorbitol and 1,3:2,4-dibenzylidene sorbitol are preferred among the internal releasing agents.

The content of the internal releasing agent is preferably from 10 to 10,000 ppm by mass, and more preferably from 100 to 5,000 ppm by mass, based on the composition of the resin for the shell component. When the content of the internal releasing agent is 10 ppm by mass or more, the function of the releasing agent is exhibited, and when it is 10,000 ppm by mass or less, the function of the releasing agent and the economy are well balanced.

2. Core Component

The core component of the core/shell type composite fibers preferably contains the low crystalline polypropylene C and the contents thereof are preferably from 90 to 100% by mass for the low crystalline polypropylene C and from 0 to 10% by mass for the high crystalline polypropylene. When the low crystalline polypropylene C is 90% by mass or more, sufficient elastic recovery property is obtained, and the low crystalline polypropylene C is preferably 100% by mass for providing the highest elastic recovery property.

3. Composite Fibers

The core/shell type composite fibers of the present invention preferably satisfy the following conditions. In the following description, the abbreviations below are used.

Ws: mass percentage of the shell component

Wc: mass percentage of the core component

Xs: mass percentage of the low crystalline polypropylene C in the shell component Xc: mass percentage of the low crystalline polypropylene C in the core component In the core/shell type composite fibers of the present invention, the ratio of the shell component to the core component (Ws/Wc) is preferably in a range of from 50/50 to 10/90. When the condition is satisfied, good elastic recovery property is exhibited.

In the core/shell type composite fibers of the present invention, the core component preferably contains the low crystalline polypropylene C in a larger content than the shell component. In other words, Wc×Xc is preferably larger than Ws×Xs. When the core/shell type composite fibers satisfy the condition, both high elastic recovery property and good continuous moldability are achieved simultaneously.

In the core/shell type composite fibers of the present invention, the total content of the low crystalline polypropylene C, which is calculated by the following expression, is preferably from 90 to 99% by mass. When it is 90% by mass or more, sufficient elastic recovery property is obtained, and when it is 99% by mass or less, deterioration in moldability due to adhesion to the calender roller and stickiness of the nonwoven fabric can be prevented.

$$\text{Total content of low crystalline polypropylene content } C=\{Ws\ (\%)\times Xs\ (\%)+Wc\ (\%)\times Xc\ (\%)\}/100\ (\%)$$

The mass percentage of the shell component and the mass percentage of the core component can be controlled by adjusting the resin discharging amount for the core part and the shell part in the core/shell composite nozzle used for forming the nonwoven fabric.

Depending on necessity, various additives may be added to the resin compositions for the shell component and the core component used for producing the core/shell type composite fibers of the present invention. Examples of the additives include an antioxidant, a neutralizing agent, a slipping agent, an antiblocking agent, an antifoggant and an antistatic agent. The additives may be used solely or as a combination of two or more kinds thereof. For example, examples of the antioxidant include a phosphorus antioxidant, a phenol antioxidant and a sulfur antioxidant. These may be added upon preparing the resin composition for the shell component and the core component, or may be added upon producing the low crystalline polypropylene C.

[Elastic Nonwoven Fabric C and Fiber Product]

The elastic nonwoven fabric C of the present invention can be produced by such a method as the melt-blow method and the spunbond method, and the production method may be appropriately selected depending on the purpose of the elastic nonwoven fabric C.

In the melt-blow method, a molten product of the resin is extruded from nozzles and is made in contact with a heated gas flow at a high speed to form fine fibers, and the fine fibers are collected to a movable collecting surface to form a nonwoven fabric, thereby producing the elastic nonwoven fabric C. The nonwoven fabric produced by the melt-blow method has a small average diameter of the fibers constituting the nonwoven fabric, and thus has good texture.

In the spunbond method, the resin having been melt-kneaded is spun, stretched and filamentized to form continuous long fibers, and in the subsequent continuous process, the long fibers are accumulated and entwined on the movable collecting surface, thereby forming the elastic nonwoven fabric C. In the spunbond method, the elastic nonwoven fabric C can be produced continuously, and the elastic nonwoven fabric C produced by the spunbond method has large strength since the stretched continuous long fibers are used as the fibers constituting the nonwoven fabric.

The fiber product using the elastic nonwoven fabric C of the present invention is not particularly limited, and examples thereof include those described as the fiber products using the elastic nonwoven fabric A according to the first invention of the present invention.

EXAMPLE

The present invention will be described in more detail with reference to examples below, but the present invention is not limited thereto.

Example 1-1

Production of Elastic Nonwoven Fabric A (1) Production of Low Crystalline Polypropylene 20 L/h of n-heptane, 15 mmol/h of triisobutylaluminum, 6 μmol/h in terms of zirconium of a catalyst component, which was obtained in advance by making dimethylanilinium tetrakispentafluoroborate, (1,2'-dimethylsilylene)(2,1'-dimethylsilylene)-bis(3-trimethylsilylmethylindenyl) zirconium dichloride, triisobutylaluminum and propylene in contact with each other at a mass ratio of 1/2/20, were continuously fed to a stainless steel rector having an inner capacity of 20 L equipped with a stirrer.

After setting the polymerization temperature to 70° C., propylene and hydrogen were continuously fed to maintain the hydrogen concentration in the gas phase of the reactor to 8% by mol and the total pressure in the reactor to 0.7 MPa·G, thereby performing polymerization reaction.

Irganox 1010 (produced by Ciba Specialty Chemicals Co., Ltd.) as a stabilizer was added to the resulting polymerization solution to have a content ratio thereof of 500 ppm by mass, and then n-heptane as the solvent was removed to provide low crystalline polypropylene.

The resulting low crystalline polypropylene was measured for the melting point (Tm-D), the stereoregularity index ([mm]), the meso pentad fraction [mmmm], the racemic-meso-racemic-meso fraction [rmrm], [rrrr]/(1−[mmmm]), [mm]×[rr]/[mr]$^2$, the mass average molecular weight (Mw) and the molecular weight distribution (Mw/Mn) by the aforementioned methods. The results are shown in Table 1.

(2) Molding of Elastic Nonwoven Fabric

85% by mass of the low crystalline polypropylene obtained in the item (1) and 15% by mass of high crystalline polypropylene (HF461Y, produced by Basel Inc.) having a melt flow rate (MFR) of 1,500 g per 10 minutes measured under conditions of a temperature of 230° C. under a load of 21.18N according to JIS K7210 were mixed to prepare a crystalline resin composition. The crystalline resin composition was measured for the crystallization temperature (Tc) by the aforementioned method. The result is shown in Table 1.

The crystalline resin composition was then molded by feeding to an apparatus equipped with a single screw extruder having a gear pump with a screw diameter of 65 mm, a die (pore diameter: 0.36 mm, pore number: 720), a high temperature compressed air generator, a net conveyer and a winder, thereby providing an elastic nonwoven fabric. Specifically, the crystalline resin composition was melted at a resin temperature of 220° C., and the crystalline resin composition in a molten state was discharged as a filament product through the die at a rate of 0.3 g/min per single pore. The filament product was sprayed onto the net conveyer at a line speed of 2.5 m/min with compressed air at 0.13 MPa and 226° C. to provide an elastic nonwoven fabric. The elastic nonwoven fabric conveyed with the net conveyer was wound with the winder into a roll form.

The resulting elastic nonwoven fabric was subjected to the following measurements and evaluations. The results are shown in Table 2.

(1) Measurement of Elastic Recovery Property

A test piece having a length of 200 mm and a width of 25 mm was sampled from the resulting elastic nonwoven fabric in the machine direction (MD) and the transversal direction (TD) perpendicular to the machine direction. By using a tensile tester (Autograph AG-1, produced by Shimadzu Corporation), the test piece was stretched from the initial length $L_0$ of 100 mm at a stretching speed of 300 mm/min to 100%, then immediately returned at 300 mm/min, and the length L (mm) where the stress reached 0 was measured. The elastic recovery property (%) was calculated by the following expression.

$$\text{elastic recovery property (\%)}=(2-L/L_0)\times 100$$

(2) Evaluation of Stickiness of Elastic Nonwoven Fabric

The hand feeling was evaluated by ten panelists. The case where no stickiness was observed was evaluated as score 2, the case where slight stickiness was observed was evaluated as score 1, and the case where stickiness was observed was evaluated as score 0. A total score of the 10 panelists of 14 or more was evaluated as A, a total score of from 10 to 13 was evaluated as B, and a total score of 9 or less was evaluated as C.

(3) Spinning Property

In Examples 1-1 and 1-2 and Comparative Example 1-1, the number of broken yarns among the yarns obtained from 168 nozzles of the die during spinning for 1 hour was evaluated, and in Examples 1-3 to 1-5, the number of broken yarns among the yarns obtained from all the nozzles during spinning for 1 hour was evaluated. In Examples 1-1 and 1-2 and Comparative Example 1-1, the results obtained by evaluating the yarns obtained from all the nozzles were the same as the results obtained by evaluating the yarns obtained from 168 nozzles.

A: no breakage

B: 1 to 2 yarns broken

D: 3 or more yarns broken (4) Roping

Occurrence of the phenomenon where adjacent yarns were adhered into a bundle (roping) between the nozzles and the ejector was visually confirmed.

A: no occurrence

B: little occurrences

D: frequent occurrences (5) Heat Fusing Property

The embossing temperature where a web was heat-fused with an embossing roller to form a nonwoven fabric was evaluated. When the temperature is too high, the web was attached to the roller and wound thereon, and when the temperature is too low, sufficient adhesion strength is not obtained to cause fuzz and ravel. The temperature, at which adhesion to roller and fuzz do not occur, is defined as the embossing temperature. The evaluation conditions were as follows.

Embossing pressure (linear pressure): 39.2 kN/m

Speed: 5 m/min

Web width: 0.5 m

Example 1-2

Production of Elastic Nonwoven Fabric A

An elastic nonwoven fabric was molded in the same manner as in Example 1-1 except that the mixing ratio was 92.5% by mass of the low crystalline polypropylene and 7.5% by mass of the high crystalline polypropylene in Example 1-1, and was subjected to the same measurements and evaluations. The results are shown in Tables 1 and 2.

Example 1-3

Production of Elastic Nonwoven Fabric A

Low crystalline polypropylene was obtained in the same manner as in Example 1-1 except that the polymerization temperature was 67° C., and propylene and hydrogen were continuously fed to maintain the hydrogen concentration in the gas phase of the reactor to 0.8% by mol and the total pressure in the reactor to 0.75 MPa·G in the polymerization reaction in Example 1-1.

The resulting low crystalline polypropylene was measured in the same manner as in Example 1-1. The results are shown in Table 1.

95% by mass of the low crystalline polypropylene and 5% by mass of high crystalline polypropylene (Y6005GM, produced by Prime Polymer Co., Ltd.) having an MFR of 60 g per 10 minutes measured under conditions of a temperature of 230° C. under a load of 21.18 N according to JIS K7210 were mixed to prepare a crystalline resin composition. The crystalline resin composition was measured for the crystallization (Tc) by the aforementioned method. The result is shown in Table 1.

The crystalline resin composition was then melt-extruded at a resin temperature of 220° C. with a single screw extruder having a gear pump with a screw diameter of 65 mm, and the molten resin was spun by discharging from nozzles having a nozzle diameter of 0.5 mm (number of pores: 501) at a rate of 0.5 g/min per single pore. The fibers obtained by spinning were aspirated with an ejector disposed below the nozzles with a distance of 1,400 mm at an ejector pressure of 0.22 MPa while cooling with air at a temperature of 15° C. and a wind speed of 0.8 m/sec, and the fibers were accumulated on a net surface, which was moved at a line speed of 5 m/min, below the nozzle with a distance of 255 mm. The fiber bundles accumulated on the net surface were embossed with an embossing roller heated to 40° C. at a linear pressure of 39.2 kN/m and wound on a winding roller.

The resulting elastic nonwoven fabric was subjected to the same measurements and evaluations as in Example 1-1. The results are shown in Table 2.

Example 1-4

Production of Elastic Nonwoven Fabric A

An elastic nonwoven fabric was molded in the same manner as in Example 1-3 except that the high crystalline polypropylene (Y6005GM, decomposed product with peroxide, produced by Prime Polymer Co., Ltd.) was changed to high crystalline polypropylene (Y2000GP, non-decomposed product, produced by Prime Polymer Co., Ltd.), the nozzle diameter used for molding the elastic nonwoven fabric was changed to 0.3 mm, the number of pores was changed to 841 pores, the ejector pressure was changed to 0.40 MPa, and the line speed was changed to 11 m/min in Example 1-3, and was subjected to the same measurements and evaluations. The results are shown in Tables 1 and 2.

Example 1-5

Production of Elastic Nonwoven Fabric A

An elastic nonwoven fabric was molded in the same manner as in Example 1-4 except that the mixing ratio was 98% by mass of the low crystalline polypropylene and 2% by mass of the high crystalline polypropylene in Example 1-4, and was subjected to the same measurements and evaluations. The results are shown in Tables 1 and 2.

Example 1-6

Production of Elastic Nonwoven Fabric A

An elastic nonwoven fabric was molded in the same manner as in Example 1-1 except that the mixing ratio was 40% by mass of the low crystalline polypropylene and 60% by mass of the high crystalline polypropylene in Example 1-1, and was subjected to the same measurements and evaluations. The results are shown in Tables 1 and 2.

TABLE 1

| | Low crystalline polypropylene | | | | | | | | Low | High | |
|---|---|---|---|---|---|---|---|---|---|---|---|
| | Tm-D (° C.) | [mm] (% by mol) | [mmmm] (% by mol) | [mrm] (% by mol) | [rrrr]/(1 − [mmmm]) | [mm] × [rr]/[mr]$^2$ | Mw | Mw/Mn | crystalline polypropylene (% by mass) | crystalline polypropylene (% by mass) | Tc (° C.) |
| Example 1-1 | 70 | 65 | 44.6 | 2.7 | 0.036 | 1.4 | 70,000 | 2.0 | 85 | 15 | 80 |
| Example 1-2 | 70 | 65 | 44.6 | 2.7 | 0.036 | 1.4 | 70,000 | 2.0 | 92.5 | 7.5 | 65 |
| Example 1-3 | 70 | 65 | 44.6 | 2.7 | 0.036 | 1.4 | 120,000 | 2.0 | 95 | 5 | 58 |
| Example 1-4 | 70 | 65 | 44.6 | 2.7 | 0.036 | 1.4 | 120,000 | 2.0 | 95 | 5 | 58 |
| Example 1-5 | 70 | 65 | 44.6 | 2.7 | 0.036 | 1.4 | 120,000 | 2.0 | 98 | 2 | 30 |
| Example 1-6 | 70 | 65 | 44.6 | 2.7 | 0.036 | 1.4 | 70,000 | 2.0 | 40 | 60 | 105 |

TABLE 2

| | Areal weight of evaluated web (g/m$^2$) | Elastic recovery property (%) | Stickiness | Spinning property | Roping | Embossing temperature (° C.) |
|---|---|---|---|---|---|---|
| Example 1-1 | 130 | 70 | A | A | A | 25 |
| Example 1-2 | 130 | 75 | A | A | A | 25 |
| Example 1-3 | 80 | 85 | B | A | A | 40 |
| Example 1-4 | 80 | 85 | B | A | A | 40 |
| Example 1-5 | 80 | 90 | B | A | A | 40 |
| Example 1-6 | 130 | 50 | A | A | A | 25 |

Example 2-1

Production of Elastic Nonwoven Fabric B (1) Production of Low Crystalline Polypropylene 20 L/h of n-heptane, 15 mmol/h of triisobutylaluminum, 6 μmol/h in terms of zirconium of a catalyst component, which was obtained in advance by making dimethylanilinium tetrakispentafluoroborate, (1,2'-dimethylsilylene)(2,1'-dimethylsilylene)-bis(3-trimethylsilylmethylindenyl) zirconium dichloride, triisobutylaluminum and propylene in contact with each other at a mass ratio of 1/2/20, were continuously fed to a stainless steel rector having an inner capacity of 20 L equipped with a stirrer.

After setting the polymerization temperature to 70° C., propylene and hydrogen were continuously fed to maintain the hydrogen concentration in the gas phase of the reactor to 8% by mol and the total pressure in the reactor to 0.7 MPa·G, thereby performing polymerization reaction.

Irganox 1010 (produced by Ciba Specialty Chemicals Co., Ltd.) as a stabilizer was added to the resulting polymerization solution to have a content ratio thereof of 500 ppm by mass, and then n-heptane as the solvent was removed to provide low crystalline polypropylene.

The resulting low crystalline polypropylene was measured for the melting point (Tm-D), the stereoregularity index ([mm]), the meso pentad fraction [mmmm], the racemic-meso-racemic-meso fraction [rmrm], [rrrr]/(1−[mmmm]), $[mm]\times[rr]/[mr]^2$, the mass average molecular weight (Mw) and the molecular weight distribution (Mw/Mn) by the aforementioned methods. The results are shown in Table 3.

(2) Molding of Elastic Nonwoven Fabric

The low crystalline polypropylene obtained in the item (1) was melt-extruded at a resin temperature of 220° C. with a single screw extruder having a gear pump with a screw diameter of 65 mm, and the molten resin was spun by discharging from nozzles having a nozzle diameter of 0.3 mm (number of pores: 841) at a rate of 0.5 g/min per single pore. The fibers obtained by spinning were aspirated with an ejector disposed below the nozzles with a distance of 1,400 mm at an ejector pressure of 0.22 MPa while cooling with air at a temperature of 15° C. and a wind speed of 0.8 m/sec, and the fibers were accumulated on a net surface, which was moved at a line speed of 11 m/min, below the nozzle with a distance of 255 mm, while spraying a silicone releasing agent (Tozai Corporation Silicon Release Agent Srease PC) onto the net surface. The fiber bundles accumulated on the net surface were embossed with an embossing roller heated to 40° C. at a linear pressure of 39.2 kN/m and wound on a winding roller.

The resulting elastic nonwoven fabric was subjected to the following measurements and evaluations. The results are shown in Table 4.

(1) Measurement of Elastic Recovery Property

A test piece having a length of 200 mm and a width of 25 mm was sampled from the resulting elastic nonwoven fabric in the machine direction (MD) and the transversal direction (TD) with respect to the machine direction. By using a tensile tester (Autograph AG-I, produced by Shimadzu Corporation), the test piece was stretched from the initial length $L_0$ of 100 mm at a stretching speed of 300 mm/min to 100%, then immediately returned at 300 mm/min, and the length L (mm) where the stress reached 0 was measured. The elastic recovery property (%) was calculated by the following expression.

$$\text{elastic recovery property (\%)}=(2-L/L_0)\times 100$$

(2) Evaluation of Stickiness of Elastic Nonwoven Fabric

The hand feeling was evaluated by ten panelists.

The case where no stickiness was observed was evaluated as score 2, the case where slight stickiness was observed was evaluated as score 1, and the case where stickiness was observed was evaluated as score 0. A total score of the 10 panelists of 14 or more was evaluated as A, a total score of from 10 to 13 was evaluated as B, and a total score of 9 or less was evaluated as C.

(3) Roller Releasing Property

The number of times of winding on the calender roller during molding for 1 hour was evaluated.

A: no winding

B: winding once or twice

C: winding thrice or more (4) Roping

Occurrence of the phenomenon where adjacent yarns were adhered into a bundle (roping) between the nozzles and the ejector was visually confirmed.

A: no occurrence

D: occurred (5) Heat Fusing Property

The embossing temperature where a web was heat-fused with an embossing roller to form a nonwoven fabric was evaluated. When the temperature is too high, the web was attached to the roller and wound thereon, and when the temperature is too low, sufficient adhesion strength is not obtained to cause fuzz and ravel. The temperature, at which adhesion to roller and fuzz do not occur, is defined as the embossing temperature. The evaluation conditions were as follows.

Embossing pressure (linear pressure): 39.2 kN/m

Speed: 11 m/min

Web width: 0.5 m

Example 2-2

Production of Elastic Nonwoven Fabric B

An elastic nonwoven fabric was molded in the same manner as in Example 2-1 except that 5,000 ppm by mass of an internal releasing agent (Gel All MD, produced by New Japan Chemical Co., Ltd.) was added to the low crystalline polypropylene, and the releasing agent was not used upon molding in Example 2-1, and was subjected to the same measurements and evaluations. The results are shown in Tables 3 and 4.

Example 2-3

Production of Elastic Nonwoven Fabric B

An elastic nonwoven fabric was molded in the same manner as in Example 2-1 except that 500 ppm by mass of an internal releasing agent (Gel All MD, produced by New Japan Chemical Co., Ltd.) was added to the low crystalline polypropylene, and the releasing agent was not used upon molding in Example 2-1, and was subjected to the same measurements and evaluations. The results are shown in Tables 3 and 4.

Example 2-4

Production of Elastic Nonwoven Fabric B

An elastic nonwoven fabric was molded in the same manner as in Example 2-1 except that 10,000 ppm by mass of high crystalline polypropylene (Y2000PG, produced by Prime Polymer Co., Ltd.) as an internal releasing agent was added to the low crystalline polypropylene, and the releasing agent was not used upon molding in Example 2-1, and was subjected to the same measurements and evaluations. The results are shown in Tables 3 and 4.

Example 2-5

Production of Elastic Nonwoven Fabric B

An elastic nonwoven fabric was molded in the same manner as in Example 2-1 except that 500 ppm by mass of an internal releasing agent (Gel All MD, produced by New Japan Chemical Co., Ltd.) was added to the low crystalline polypropylene in Example 2-1, and was subjected to the same measurements and evaluations. The results are shown in Tables 3 and 4.

Comparative Example 2-1

An elastic nonwoven fabric was molded in the same manner as in Example 2-1 except the releasing agent was not used upon molding in Example 2-1, and was subjected to the same measurements and evaluations. The results are shown in Tables 3 and 4.

Example 2-6

Production of Elastic Nonwoven Fabric B (1) Production of Low Crystalline Polypropylene 20 L/h of n-heptane, 15 mmol/h of triisobutylaluminum, 6 μmol/h in terms of zirconium of a catalyst component, which was obtained in advance by making dimethylanilinium tetrakispentafluoroborate, (1,2'-dimethylsilylene)(2,1'-dimethylsilylene)-bis(3-trimethylsilylmethylindenyl) zirconium dichloride, triisobutylaluminum and propylene in contact with each other at a mass ratio of 1/2/20, were continuously fed to a stainless steel rector having an inner capacity of 20 L equipped with a stirrer.

After setting the polymerization temperature to 67° C., propylene and hydrogen were continuously fed to maintain the hydrogen concentration in the gas phase of the reactor to 0.8% by mol and the total pressure in the reactor to 0.75 MPa·G, thereby performing polymerization reaction.

Irganox 1010 (produced by Ciba Specialty Chemicals Co., Ltd.) as a stabilizer was added to the resulting polymerization solution to have a content ratio thereof of 500 ppm by mass, and then n-heptane as the solvent was removed to provide low crystalline polypropylene.

The resulting low crystalline polypropylene was measured for the melting point (Tm-D), the stereoregularity index ([mm]), the meso pentad fraction [mmmm], the racemic-meso-racemic-meso fraction [rmrm], [rrrr]/(1−[mmmm]), [mm]×[rr]/[mr]$^2$, the mass average molecular weight (Mw) and the molecular weight distribution (Mw/Mn) by the aforementioned methods. The results are shown in Table 3.

(2) Molding of Elastic Nonwoven Fabric

The low crystalline polypropylene obtained in the item (1) was melt-extruded at a resin temperature of 220° C. with a single screw extruder having a gear pump with a screw diameter of 65 mm, and the molten resin was spun by discharging from nozzles having a nozzle diameter of 0.3 mm (number of pores: 841) at a rate of 0.5 g/min per single pore. The fibers obtained by spinning were aspirated with an ejector disposed below the nozzles with a distance of 1,400 mm at an ejector pressure of 0.22 MPa while cooling with air at a temperature of 15° C. and a wind speed of 0.8 m/sec, and the fibers were accumulated on a net surface, which was moved at a line speed of 11 m/min, below the nozzle with a distance of 255 mm, while spraying a silicone releasing agent (Tozai Corporation Silicon Release Agent Srease PC) onto the net surface. The fiber bundles accumulated on the net surface were embossed with an embossing roller heated to 40° C. at a linear pressure of 39.2 kN/m and wound on a winding roller.

The resulting elastic nonwoven fabric was subjected to the same measurements and evaluations. The results are shown in Table 4.

Example 2-7

Production of Elastic Nonwoven Fabric B

An elastic nonwoven fabric was molded in the same manner as in Example 2-6 except that 5,000 ppm by mass of an internal releasing agent (Gel All MD, produced by New Japan Chemical Co., Ltd.) was added to the low crystalline polypropylene, and the releasing agent was not used upon molding in Example 2-6, and was subjected to the same measurements and evaluations. The results are shown in Tables 3 and 4.

Example 2-8

Production of Elastic Nonwoven Fabric B

An elastic nonwoven fabric was molded in the same manner as in Example 2-6 except that 500 ppm by mass of an internal releasing agent (Gel All MD, produced by New Japan Chemical Co., Ltd.) was added to the low crystalline polypropylene, and the releasing agent was not used upon molding in Example 2-6, and was subjected to the same measurements and evaluations. The results are shown in Tables 3 and 4.

Example 2-9

Production of Elastic Nonwoven Fabric B

An elastic nonwoven fabric was molded in the same manner as in Example 2-6 except that 10,000 ppm by mass of high crystalline polypropylene (Y2000PG, produced by Prime Polymer Co., Ltd.) as an internal releasing agent was added to the low crystalline polypropylene, and the releasing agent was not used upon molding in Example 2-6, and was subjected to the same measurements and evaluations. The results are shown in Tables 3 and 4.

Example 2-10

Production of Elastic Nonwoven Fabric B

An elastic nonwoven fabric was molded in the same manner as in Example 2-6 except that 500 ppm by mass of an internal releasing agent (Gel All MD, produced by New Japan Chemical Co., Ltd.) was added to the low crystalline polypropylene in Example 2-6, and was subjected to the same measurements and evaluations. The results are shown in Tables 3 and 4.

COMPARATIVE EXAMPLE 2-2

An elastic nonwoven fabric was molded in the same manner as in Example 2-6 except the releasing agent was not used upon molding in Example 2-6, and was subjected to the same measurements and evaluations. The results are shown in Tables 3 and 4.

After setting the polymerization temperature to 67° C., propylene and hydrogen were continuously fed to maintain the hydrogen concentration in the gas phase of the reactor to 2% by mol and the total pressure in the reactor to 0.8 MPa·G, thereby performing polymerization reaction.

Irganox 1010 (produced by Ciba Specialty Chemicals Co., Ltd.) as a stabilizer was added to the resulting polymerization solution to have a content ratio thereof of 500 ppm by mass, and then n-heptane as the solvent was removed to provide low crystalline polypropylene.

The resulting low crystalline polypropylene was measured for the melting point (Tm-D), the stereoregularity

TABLE 3

| | Low crystalline polypropylene | | | | | | | | Gel All | | |
|---|---|---|---|---|---|---|---|---|---|---|---|
| | Tm-D (° C.) | [mm] (% by mol) | [mmmm] (% by mol) | [rmrm] (% by mol) | [rrrr]/(1 − [mmmm]) | [mm] × [rr]/[mr]$^2$ | Mw | Mw/Mn | Silicone releasing agent | MD (ppm by mass) | Y2000GP (ppm by mass) |
| Example 2-1 | 70 | 65 | 44.6 | 2.7 | 0.036 | 1.4 | 70,000 | 2.0 | used | 0 | 0 |
| Example 2-2 | 70 | 65 | 44.6 | 2.7 | 0.036 | 1.4 | 70,000 | 2.0 | not used | 5,000 | 0 |
| Example 2-3 | 70 | 65 | 44.6 | 2.7 | 0.036 | 1.4 | 70,000 | 2.0 | not used | 500 | 0 |
| Example 2-4 | 70 | 65 | 44.6 | 2.7 | 0.036 | 1.4 | 70,000 | 2.0 | not used | 0 | 10,000 |
| Example 2-5 | 70 | 65 | 44.6 | 2.7 | 0.036 | 1.4 | 70,000 | 2.0 | used | 500 | 0 |
| Comparative Example 2-1 | 70 | 65 | 44.6 | 2.7 | 0.036 | 1.4 | 70,000 | 2.0 | not used | 0 | 0 |
| Example 2-6 | 70 | 65 | 44.6 | 2.7 | 0.036 | 1.4 | 120,000 | 2.0 | used | 0 | 0 |
| Example 2-7 | 70 | 65 | 44.6 | 2.7 | 0.036 | 1.4 | 120,000 | 2.0 | not used | 5,000 | 0 |
| Example 2-8 | 70 | 65 | 44.6 | 2.7 | 0.036 | 1.4 | 120,000 | 2.0 | not used | 500 | 0 |
| Example 2-9 | 70 | 65 | 44.6 | 2.7 | 0.036 | 1.4 | 120,000 | 2.0 | not used | 0 | 10,000 |
| Example 2-10 | 70 | 65 | 44.6 | 2.7 | 0.036 | 1.4 | 120,000 | 2.0 | used | 500 | 0 |
| Comparative Example 2-2 | 70 | 65 | 44.6 | 2.7 | 0.036 | 1.4 | 120,000 | 2.0 | not used | 0 | 0 |

TABLE 4

| | Areal weight of evaluated web (g/m$^2$) | Elastic recovery property (%) | Stickiness | Roller releasing property | Roping | Embossing temperature (° C.) |
|---|---|---|---|---|---|---|
| Example 2-1 | 80 | 90 | B | A | A | 40 |
| Example 2-2 | 80 | 90 | A | A | A | 40 |
| Example 2-3 | 80 | 90 | B | A | A | 40 |
| Example 2-4 | 80 | 90 | A | A | A | 40 |
| Example 2-5 | 80 | 90 | B | A | A | 40 |
| Comparative Example 2-1 | 80 | 90 | C | C | A | 40 |
| Example 2-6 | 80 | 90 | B | | A | 40 |
| Example 2-7 | 80 | 90 | A | A | A | 40 |
| Example 2-8 | 80 | 90 | B | A | A | 40 |
| Example 2-9 | 80 | 90 | A | A | A | 40 |
| Example 2-10 | 80 | 90 | B | A | A | 40 |
| Comparative Example 2-2 | 80 | 90 | C | C | A | 40 |

Example 3-1

Production of Elastic Nonwoven Fabric C (1) Production of Low Crystalline Polypropylene 20 L/h of n-heptane, 15 mmol/h of triisobutylaluminum, 6 μmol/h in terms of zirconium of a catalyst component, which was obtained in advance by making dimethylanilinium tetrakispentafluoroborate, (1,2'-dimethylsilylene)(2,1'-dimethylsilylene)-bis(3-trimethylsilylmethylindenyl) zirconium dichloride, triisobutylaluminum and propylene in contact with each other at a mass ratio of 1/2/20, were continuously fed to a stainless steel rector having an inner capacity of 20 L equipped with a stirrer.

index ([mm]), the meso pentad fraction [mmmm], the racemic-meso-racemic-meso fraction [rmrm], [rrrr]/(1−[mmmm]), [mm]×[rr]/[mr]$^2$, the mass average molecular weight (Mw) and the molecular weight distribution (Mw/Mn) by the aforementioned methods. The results are shown in Table 5.

TABLE 5

| | Example 3-1 |
|---|---|
| Melting point (Tm-D) | 70 |
| [mm] (% by mol) | 65 |
| [mmmm] (% by mol) | 44.6 |
| [rmrm] (% by mol) | 2.7 |

TABLE 5-continued

| | Example 3-1 |
|---|---|
| [rrrr]/(1 − [mmmm]) | 0.036 |
| [mm] × [rr]/[mr]$^2$ | 1.4 |
| Mw | 110,000 |
| Mw/Mn | 2.0 |

(2) Molding of Elastic Nonwoven Fabric

As the shell component, a mixture in a pellet form of 60% by mass of the low crystalline polypropylene obtained in the item (1) and 40% by mass of high crystalline polypropylene having a melt flow rate (MFR) of 20 g per 10 minutes measured according to JIS K7210 at a temperature of 230° C. under a load of 21.18 N (Y2000PG, produced by Prime Polymer Co., Ltd.) was used, and as the core component, the low crystalline polypropylene was used solely.

The nonwoven fabric was molded by using a spunbond apparatus (Reicofil 4, produced by Reicofil GmbH). The shell component resin and the core component resin were each melt-extruded at a resin temperature of 220° C. with separate single screw extruders respectively, and spun by discharging the molten resin from nozzles having a nozzle diameter of 0.6 mm (number of pores: 7,377) at a rate of 0.5 g/min per single pore and a ratio of (shell component)/(core component) of 10/90.

The fibers obtained by spinning were accumulated on a net surface, which was moved at a line speed of 60 m/min, at a temperature of 16° C. and a cabin pressure of 4,000 Pa. The fiber bundles accumulated on the net surface were embossed with an embossing roller heated to 70° C. at a linear pressure of 20 N/mm and wound on a winding roller.

The resulting elastic nonwoven fabric was subjected to the following measurements and evaluations. The results are shown in Table 6.

[Measurement and Evaluation]

(1) Continuous Molding Property

The number of times of winding on the calender roller during molding for 1 hour was evaluated.

A: no winding

B: winding once or twice

C: winding thrice or more (2) Releasing Property from Winding Roller

The nonwoven fabric wound on the roll was allowed to stand at room temperature for 2 weeks, and then peeled off from the roller. The case where the nonwoven fabric was adhered and unable to be peeled was evaluated as D, and the case it was not adhered was evaluated as B.

(3) Measurement of Elastic Recovery Property

A test piece having a length of 200 mm and a width of 25 mm was sampled from the resulting elastic nonwoven fabric in the machine direction (MD) and the transversal direction (TD) with respect to the machine direction. By using a tensile tester (Autograph AG-1, produced by Shimadzu Corporation), the test piece was stretched from the initial length $L_0$ of 100 mm at a stretching speed of 300 mm/min to 100%, then immediately returned at 300 mm/min, and the length L (mm) where the stress reached 0 was measured. The elastic recovery property (%) was calculated by the following expression.

$$\text{elastic recovery property (\%)}=(2-L/L_0)\times 100$$

(4) Evaluation of Stickiness of Elastic Nonwoven Fabric

The hand feeling was evaluated by ten panelists.

The case where no stickiness was observed was evaluated as score 2, the case where slight stickiness was observed was evaluated as score 1, and the case where stickiness was observed was evaluated as score 0. A total score of the 10 panelists of 14 or more was evaluated as A, a total score of from 10 to 13 was evaluated as B, and a total score of 9 or less was evaluated as C.

(5) Shrinkage on application of HMA (hot-melt adhesive)

An SBS hot-melt adhesive was applied to the elastic nonwoven fabric from a nozzle having a diameter of 0.5 mm disposed at a height of 35 mm at a nozzle air pressure of 0.03 MPa, an application temperature of 160° C., an application amount of 0.6 g/m and a line speed of 10 m/min with a spray applicator, produced by Nordson Co., Ltd. The appearance of the applied surface was observed to evaluate the presence of surface roughness due to shrinkage.

Example 3-2

Production of Elastic Nonwoven Fabric C

An elastic nonwoven fabric was molded in the same manner as in Example 3-1 except that the content of the low crystalline polypropylene in the shell component was 90% by mass, and the ratio of (shell component)/(core component) was 50/50 in Example 3-1, and was subjected to the same measurements and evaluations. The results are shown in Table 6.

Example 3-3

Production of Elastic Nonwoven Fabric C

An elastic nonwoven fabric was molded in the same manner as in Example 3-1 except that the content of the low crystalline polypropylene in the shell component was 80% by mass, and the ratio of (shell component)/(core component) was 20/80 in Example 3-1, and was subjected to the same measurements and evaluations. The results are shown in Table 6.

Example 3-4

Production of Elastic Nonwoven Fabric C

An elastic nonwoven fabric was molded in the same manner as in Example 3-1 except that the content of the low crystalline polypropylene in the shell component was 90% by mass, and the ratio of (shell component)/(core component) was 10/90 in Example 3-1, and was subjected to the same measurements and evaluations. The results are shown in Table 6.

Example 3-5

Production of Elastic Nonwoven Fabric C

An elastic nonwoven fabric was molded in the same manner as in Example 3-1 except that the content of the low crystalline polypropylene in the shell component was 40% by mass, and the ratio of (shell component)/(core component) was 20/80 in Example 3-1, and was subjected to the same measurements and evaluations. The results are shown in Table 6.

Comparative Example 3-1

An elastic nonwoven fabric was molded in the same manner as in Example 3-1 except that the content of the low crystalline polypropylene and the content of the high crystalline polypropylene in the shell component 95% by mass and 5% by mass, respectively, and the same resin as used in the shell component was used as the core component in Example 3-1, and was subjected to the same measurements and evaluations. The results are shown in Table 6.

Comparative Example 3-2

An elastic nonwoven fabric was molded in the same manner as in Example 3-1 except that the low crystalline polypropylene was used as both the shell component and core component in Example 3-1, and was subjected to the same measurements and evaluations. The results are shown in Table 6.

TABLE 6

| | | Example | | | | | Comparative Example | |
|---|---|---|---|---|---|---|---|---|
| | | 3-1 | 3-2 | 3-3 | 3-4 | 3-5 | 3-1 | 3-2 |
| Fiber form | | core/shell | core/shell | core/shell | core/shell | core/shell | single layer | single layer |
| Shell/core ratio (wt %/wt %) | | 10/90 | 50/50 | 20/80 | 10/90 | 20/80 | — | — |
| Low crystalline polypropylene | in core component | 100 | 100 | 100 | 100 | 100 | 95 | 100 |
| | in shell component | 60 | 90 | 80 | 90 | 40 | | |
| content (% by mass) | total amount | 96 | 95 | 96 | 99 | 88 | 95 | 100 |
| Continuous molding property | | A | B | A | B | A | C | C |
| Releasing property from winding roller | | A | A | A | A | A | D | D |
| Elastic recovery property (%) | MD | 82 | 80 | 81 | 85 | 70 | 82 | 90 |
| | TD | 82 | 80 | 80 | 85 | 70 | 81 | 89 |
| Stickiness of nonwoven fabric | | A | A | A | B | A | B | C |
| Shrinkage upon application of HMA | | A | A | A | A | A | D | D |

INDUSTRIAL APPLICABILITY

The elastic nonwoven fabric of the present invention is favorably used, for example, various fabric products such as a disposable diaper, a sanitary product, a hygienic product, a clothing material, a bandage and a packaging material.

The invention claimed is:

1. An elastic nonwoven fabric, comprising core/shell composite fibers that comprise a low crystalline polypropylene, wherein a meso pentad fraction [mmmm] of the low crystalline polypropylene is from 20 to 60% by mol;

a quotient [rrrr]/(1−[mmmm]) of a racemic pentad fraction [rrrr] divided by a quantity (1−[mmmm]) in the low crystalline polypropylene is less than or equal to 0.1;

a racemic-meso-racemic-meso pentad fraction [rmrm] of the low crystalline polypropylene is greater than 2.5% by mol;

a quotient $[mm]\times[rr]/[mr]^2$ of a product of a meso triad fraction [mm] and a racemic triad fraction [rr] divided by a square of a meso-racemic triad fraction $[mr]^2$ of the low crystalline polypropylene is less than or equal to 2.0;

a mass average molecular weight (Mw) of the low crystalline polypropylene is from 10,000 to 200,000;

a molecular weight distribution (Mw/Mn) of the low crystalline polypropylene is less than 4;

a shell component of the fibers comprises from 50 to 99% by mass of the low crystalline polypropylene and from 1 to 50% by mass of high crystalline polypropylene;

a core component of the fibers comprises from 90 to 100% by mass of the low crystalline polypropylene and from 0 to 10% by mass of high crystalline polypropylene;

a melting point of the low crystalline polypropylene is from 0 to 120° C.;

a melting point of the high crystalline polypropylene is 155° C. or more;

a low crystalline content of the core component is higher than a low crystalline content of the shell component;

a total low crystalline polypropylene content of the fibers is from 90 to 96% by mass, calculated by an expression:

$$\{Ws\ (\%)\times Xs\ (\%)+Wc\ (\%)\times Xc\ (\%)\}/100(\%);$$

Ws is mass percentage of the shell component;

Wc is mass percentage of the core component;

Xs is mass percentage of the low crystalline polypropylene in the shell component; and Xc is mass percentage of the low crystalline polypropylene in the core component.

2. The elastic nonwoven fabric of claim 1, wherein the low crystalline polypropylene is obtained by a process comprising polymerization with a metallocene catalyst, and the metallocene catalyst comprises a transitional metal compound and a ligand that comprises a crosslinked structure through a bridge group.

3. The elastic nonwoven fabric of claim 1, wherein a crystallization temperature (Tc) of the high crystalline polypropylene is 100° C. or more.

4. The elastic nonwoven fabric of claim 1, wherein the shell component comprises from 60 to 95% by mass of the low crystalline polypropylene and from 5 to 40% by mass of the high crystalline polypropylene.

5. The elastic nonwoven fabric of claim 1, wherein the shell component comprises from 60 to 90% by mass of the low crystalline polypropylene and from 10 to 40% by mass of the high crystalline polypropylene.

6. The elastic nonwoven fabric of claim 1, wherein a core component of the fibers consists of the low crystalline polypropylene.

7. A fiber product comprising the elastic nonwoven fabric according to claim 1.

* * * * *